US012111131B2

(12) United States Patent
Trpkovski

(10) Patent No.: US 12,111,131 B2
(45) Date of Patent: Oct. 8, 2024

(54) CROSSBOW UTILIZING CAMS

(71) Applicant: Ravin Crossbows, LLC, Superior, WI (US)

(72) Inventor: Paul Trpkovski, Kailua Kona, HI (US)

(73) Assignee: RAVIN CROSSBOWS, LLC, Superior, WI (US)

( * ) Notice: Subject to any disclaimer, the term of this patent is extended or adjusted under 35 U.S.C. 154(b) by 266 days.

(21) Appl. No.: 17/704,852

(22) Filed: Mar. 25, 2022

(65) Prior Publication Data

US 2022/0307791 A1 Sep. 29, 2022

Related U.S. Application Data

(60) Provisional application No. 63/181,229, filed on Apr. 28, 2021, provisional application No. 63/166,181, filed on Mar. 25, 2021.

(51) Int. Cl.
*F41B 5/12* (2006.01)

(52) U.S. Cl.
CPC ..... *F41B 5/123* (2013.01)

(58) Field of Classification Search
CPC .. F41B 5/12; F41B 5/123; F41B 5/105; Y10S 124/90
USPC ..... 124/25, 900
See application file for complete search history.

(56) References Cited

U.S. PATENT DOCUMENTS 3,854,467 A * 12/1974 Hofmeister ..... F41B 5/105 124/90
4,077,385 A * 3/1978 Fredrickson ..... F41B 5/1411 124/90
4,649,891 A * 3/1987 Bozek ..... F41B 5/12 124/25
4,722,317 A * 2/1988 Hartwig ..... F41B 5/0094 124/25.6
4,766,874 A * 8/1988 Nishioka ..... F41B 5/12 124/25

(Continued)

FOREIGN PATENT DOCUMENTS

WO WO-2020/236629 A2 11/2020
WO WO-2021/034422 A1 2/2021

OTHER PUBLICATIONS

Ravin Crossbows, LLC, U.S. Appl. No. 16/840,446, Linear Crossbow, filed Apr. 5, 2020, 101 pages.

(Continued)

*Primary Examiner* — Alexander R Niconovich
(74) *Attorney, Agent, or Firm* — FOLEY & LARDNER LLP

(57) ABSTRACT

A crossbow includes a frame including a riser, a first and a second cam, a first and a second flexible limb, a first power cable, a second power cable, and a drawstring. Each cam has a larger diameter portion and a smaller diameter portion. The first power cable has a first end attached to a mounting position on the riser and a second end attached to the smaller diameter portion of the first cam. The second power cable has a first end attached to a mounting position on the riser and a second end attached to the smaller diameter portion of the second cam. The drawstring is attached to the larger diameter portion of the first cam and the larger diameter portion of the second cam. The drawstring wraps at least one full wind around the larger diameter portions of the cams when the crossbow is undrawn.

20 Claims, 24 Drawing Sheets

(56) References Cited

U.S. PATENT DOCUMENTS

| | | | | | |
|---|---|---|---|---|---|
| 4,917,071 | A * | 4/1990 | Bozek | F41B 5/12 | 124/24.1 |
| 5,678,528 | A * | 10/1997 | Hadley | F41B 5/12 | 124/25.5 |
| 6,792,931 | B1 * | 9/2004 | Schaar | F41B 5/10 | 124/25.6 |
| 7,578,289 | B2 * | 8/2009 | Norkus | F41B 5/10 | 124/44.5 |
| 7,823,572 | B2 * | 11/2010 | Anderson | F41B 5/143 | 124/25 |
| 7,891,348 | B2 * | 2/2011 | Colley | F41B 5/105 | 124/25 |
| 8,387,603 | B2 * | 3/2013 | Darlington | F41B 5/105 | 124/25 |
| 8,485,170 | B1 * | 7/2013 | Prior | F41B 5/123 | 124/25 |
| 8,522,762 | B2 * | 9/2013 | Trpkovski | F41B 5/1453 | 124/900 |
| 8,567,376 | B2 * | 10/2013 | Flint | F41B 5/12 | 124/20.3 |
| 8,701,642 | B2 * | 4/2014 | Biafore, Jr. | F41B 5/123 | 124/25 |
| 8,863,732 | B1 * | 10/2014 | Prior | F41B 5/123 | 124/25 |
| 8,997,728 | B2 * | 4/2015 | Popov | F41B 5/0094 | 124/25.6 |
| 9,234,719 | B1 * | 1/2016 | Kempf | F41B 5/12 | |
| 9,243,861 | B1 * | 1/2016 | Kempf | F41B 5/12 | |
| 9,255,756 | B1 * | 2/2016 | Wu | F41B 5/123 | |
| 9,297,604 | B1 * | 3/2016 | Sidebottom | F41B 5/105 | |
| 9,377,267 | B1 * | 6/2016 | Kempf | F41B 5/105 | |
| 9,513,080 | B1 * | 12/2016 | Kempf | F41B 5/1411 | |
| 9,714,808 | B2 * | 7/2017 | Carroll, Jr. | F41B 5/12 | |
| 9,719,749 | B1 * | 8/2017 | Prior | F41B 3/005 | |
| 9,759,509 | B1 * | 9/2017 | Kempf | F41B 5/123 | |
| 9,829,268 | B1 * | 11/2017 | Kempf | F41B 5/105 | |
| 9,879,938 | B1 * | 1/2018 | Isenhower | F41B 5/123 | |
| 10,018,442 | B1 * | 7/2018 | Kempf | F41B 5/123 | |
| 10,048,036 | B1 * | 8/2018 | Kempf | F41B 5/105 | |
| 10,077,965 | B2 * | 9/2018 | Yehle | F41B 5/10 | |
| 10,267,590 | B1 * | 4/2019 | Rinker | F41B 5/10 | |
| 10,386,151 | B2 * | 8/2019 | McPherson | F41B 5/123 | |
| 10,393,470 | B1 * | 8/2019 | Popov | F41B 5/105 | |
| 10,458,742 | B1 * | 10/2019 | Kempf | F41B 5/123 | |
| 10,473,418 | B2 * | 11/2019 | Shaffer | F41B 5/123 | |
| 10,514,226 | B2 * | 12/2019 | Shaffer | F41B 5/105 | |
| 10,533,822 | B1 * | 1/2020 | Popov | F41B 5/0094 | |
| 10,767,956 | B2 * | 9/2020 | Popov | F41B 5/123 | |
| 10,859,338 | B2 * | 12/2020 | Polanich | F41B 5/1403 | |
| 10,962,323 | B2 * | 3/2021 | Langley | F41B 5/123 | |
| 10,989,492 | B1 * | 4/2021 | Kempf | F41B 5/105 | |
| 11,022,398 | B1 * | 6/2021 | Kempf | F41B 5/105 | |
| 11,098,973 | B2 * | 8/2021 | Walthert | F41B 5/105 | |
| 11,236,962 | B2 * | 2/2022 | McPherson | F41B 5/12 | |
| 11,371,795 | B1 * | 6/2022 | Kempf | F41B 5/105 | |
| 11,378,350 | B1 * | 7/2022 | Kempf | F41B 5/123 | |
| 11,402,171 | B2 * | 8/2022 | Trpkovski | F41B 5/123 | |
| 11,408,703 | B2 * | 8/2022 | Trpkovski | F41B 3/02 | |
| 11,499,792 | B1 * | 11/2022 | Kempf | F41B 5/105 | |
| 11,512,921 | B1 * | 11/2022 | Xiao | F41B 5/0094 | |
| 11,549,777 | B1 * | 1/2023 | Trpkovski | F41B 5/0094 | |
| 11,573,062 | B2 * | 2/2023 | Haas | F41B 5/105 | |
| 11,635,274 | B2 * | 4/2023 | Trpkovski | F41B 5/123 | 124/25 |
| 11,725,899 | B2 * | 8/2023 | Trpkovski | F41B 5/123 | 124/25 |
| 11,802,748 | B1 * | 10/2023 | Wei | F41B 5/123 | |
| 11,808,543 | B2 * | 11/2023 | Yehle | F41B 5/123 | |
| 11,946,718 | B2 * | 4/2024 | Obteshka | F41B 5/123 | |
| 2012/0125302 | A1 * | 5/2012 | Stanziale | F41B 5/123 | 124/25 |
| 2018/0051954 | A1 * | 2/2018 | Yehle | F41B 5/066 | |
| 2018/0321010 | A1 | 11/2018 | Yehle | | |
| 2019/0242671 | A1 * | 8/2019 | Bartels | F41B 5/123 | |
| 2020/0182582 | A1 * | 6/2020 | Pauluhn | F41B 5/0094 | |
| 2020/0355458 | A1 * | 11/2020 | Langley | F41B 5/1411 | |
| 2020/0370856 | A1 | 11/2020 | Trpkovski | | |
| 2021/0048268 | A1 | 2/2021 | Trpkovski | | |
| 2023/0127133 | A1 * | 4/2023 | Obteshka | F41B 5/123 | 124/25 |
| 2023/0349662 | A1 * | 11/2023 | Trpkovski | F41B 5/123 | |

OTHER PUBLICATIONS

Ravin Crossbows, LLC, U.S. Appl. No. 17/571,290, Compact Projectile Launcher, filed Jan. 7, 2022, 83 pages.

International Preliminary Report on Patentability issued in International Patent Application No. PCT/US2022/022011, dated Oct. 5, 2023.

International Search Report and Written Opinion issued in International Patent Application No. PCT/US2022/022011, dated Jun. 28, 2022.

* cited by examiner $$IMA = \frac{R}{r}$$

CROSSBOW UTILIZING CAMS

BACKGROUND

This application claims priority to U.S. Provisional Application No. 63/181,229, filed on Apr. 28, 2021, titled CROSSBOW WITH MULTIPLE-WIND CAMS, and to U.S. Provisional Application No. 63/166,181, filed on Mar. 25, 2021, titled CROSSBOW WITH MULTIPLE-WIND CAMS, the disclosures of which are hereby incorporated by reference in their entireties. To the extent appropriate a claim of priority is made to each of the above-disclosed applications.

BACKGROUND

Crossbows utilize a drawstring that is drawn backward and released to fire a projectile. In crossbows, flexible limbs are typically loaded with force by the drawstring being drawn, and limbs are unloaded with force when the crossbow is fired. The unloading of the force from the flexible limbs powers the movement of the drawstring toward the front of the crossbow.

SUMMARY

This application generally relates to a crossbow. In particular, this application relates to a crossbow having cams to improve performance of the crossbow. Some configurations include one or more multiple-wind cams. In some configurations pulleys are also used to further improve performance.

Some embodiments of a crossbow in accordance with the principles of this disclosure includes a frame having a projectile axis, wherein a projectile—typically an arrow (or "bolt")—moves along the projectile axis when the crossbow is fired. A riser is attached to or part of the frame and forms a front portion of the crossbow. When the projectile is fired, it is propelled from the front end of the riser.

An example crossbow further includes first and second multiple-wind cams. The first and second multiple-wind cams are attached to the riser near the front end. Each multiple-wind cam has a larger diameter portion and a smaller diameter portion. The larger diameter portion has a larger diameter than the smaller diameter portion. In certain embodiments, helical grooves are formed in the large and smaller diameter portions.

A first flexible limb and a second flexible limb each have a first end attached to the riser. The first and second flexible limbs are in an unloaded position when the crossbow is undrawn and in a loaded position when the crossbow is drawn. The flexible limbs include second ends that move between the unloaded and loaded positions.

First and second power groups cause the second ends of the flexible limbs move between the unloaded and loaded positions when the crossbow is drawn.

The first power group is positioned at a first frame side and includes a first power cable having a first and second end. The first end is attached to the riser. The first power cable is routed around a first riser pulley that is attached to the riser and a first power cable pulley that is attached to the second end of the first flexible limb. The second end of the first power cable is attached to the smaller diameter portion of the first multiple-wind cam.

The second power group is positioned at a second frame side and includes a second power cable having a first and second end. The first end is attached to the riser. The second power cable is routed around a second riser pulley that is attached to the riser and a second power cable pulley that is attached to the second end of the second flexible limb. The second end is attached to the smaller diameter portion of the second multiple-wind cam.

A drawstring having a first and second end is attached the cams. The first end is attached to the larger diameter portion of the first cam and the second end is attached to the larger diameter portion of the second cam. The drawstring wraps around the larger diameter portions of the first and second cams at least one full wind when the crossbow is undrawn and wherein the first and second power cables wrap around the smaller diameter portions of the first and second cams at least one full wind when the crossbow is in the loaded position. In some embodiments the first and second cams are multiple-wind cams.

Another aspect is a crossbow configured to fire a projectile along a projectile axis from a front end, the crossbow comprising: a frame including a riser, the frame having a first frame side and a second frame side; a first and second cams, the first and second cams attached to the frame, each cam having a larger diameter portion and a smaller diameter portion; a first flexible limb and a second flexible limb, each of the first and second flexible limbs having a first end and a second end, wherein the first and second flexible limbs are in an unloaded position when the crossbow is undrawn and in a loaded position when the crossbow is drawn; a first power cable at the first frame side, the first power cable attached to the smaller diameter portion of the first cam; a second power cable at a second frame side, the second power cable attached to the smaller diameter portion of the second cam; a drawstring attached to the larger diameter portion of the first cam and to the larger diameter portion of the second cam; and wherein the drawstring wraps at least one full wind around the larger diameter portions of the cams when the crossbow is undrawn and wherein the first and second power cables wrap at least one full wind around the smaller diameter portions of the first and second cams respectively when the crossbow is in the loaded position.

A further aspect is a crossbow comprising: a frame including an opening along a projectile axis, wherein the crossbow is configured to move a projectile along the projectile axis during firing and arming of the crossbow, wherein the projectile is fired from a front end of the frame; a first and a second cam attached to the frame, each of the first and second cams having a larger diameter portion and a smaller diameter portion; a first flexible limb and a second flexible limb, each of the first and the second limbs having a first end attached to the frame and a second end, wherein the first and second flexible limbs are in an unloaded position when the crossbow is undrawn and in a loaded position when the crossbow is drawn; a first power group at a first frame side, the first power group including a first power cable, a first power cable pulley, a first frame pulley, and the first cam, wherein the first end of the first power cable is attached to the frame, the first power cable is routed around the first power cable pulley attached to the second end of the first flexible limb, the first power cable is further routed around the first frame pulley attached to the frame, and the second end of the first power cable is attached to the smaller diameter portion of the first cam; a second power group at a second frame side, the second power group including a second power cable, a second power cable pulley, a second frame pulley, and the second cam, wherein the first end of the second power cable is attached to the frame, the second power cable is routed around a second power cable pulley attached to the second end of the second flexible limb, the second power cable is further routed around the second frame pulley attached to the frame, and the second end of the second power cable is attached to the smaller diameter portion of the second cam; a drawstring having a first and a second end, wherein the first end of the drawstring is attached to the larger diameter portion of the first cam and the second end of the drawstring is attached to the larger diameter portion of the second cam; and wherein the drawstring wraps around the larger diameter portions of the cams when the crossbow is undrawn and wherein the first and second power cables wrap around the smaller diameter portions of the cams when the crossbow is in the loaded position.

Yet another aspect is a crossbow comprising: a frame having a projectile axis, wherein a projectile moves along the projectile axis during firing of the crossbow; a multiple-wind cam attached to the frame, having a larger diameter portion and a smaller diameter portion, wherein the larger diameter portion has a larger diameter than the smaller diameter portion; a flexible limb having a first end attached to the frame and a second end, wherein the flexible limb is in an unloaded position when the crossbow is undrawn and in a loaded position when the crossbow is drawn; a power group including a power cable having a first and second end, the first end attached to the frame, the power cable routed around a pulley, and the second end attached to the smaller diameter portion of the multiple-wind cam; and a drawstring having a first and second end, wherein the first end is attached to the larger diameter portion of the multiple-wind cam, wherein the drawstring wraps around the larger diameter portion of the multiple-wind cam when the crossbow is undrawn and wherein the power cable wraps around the smaller diameter portion of the multiple-wind cam when the crossbow is in the loaded position.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The crossbows disclosed herein can be used in a variety of different arrangements to improve efficiency, improve balance, improve safety, shoot different projectiles, and improve accuracy. The draw weight of the drawstring is the pulling force required to draw the drawstring to a rear of the crossbow. By introducing a mechanical advantage to the draw weight of the drawstring, power cables can load powerful flexible limbs with less pulling force. Because a powerful flexible limb can be loaded, the flexible limb can power the drawstring more aggressively (i.e., move faster) toward the front of the crossbow when firing, thus leading to firing a projectile at a faster speed. Cams, including multiple-wind cams in some embodiments, having a larger diameter portion and a smaller diameter portion reduce the amount of force needed to draw the drawstring of the crossbow without sacrificing firing power, thus making the crossbow accurate and powerful. Further still, the crossbow includes a frame that allows the crossbow to remain compact and stable while operating efficiently and effectively.

FIGS. 1-17 show one embodiment of a crossbow 100 according to the principles of the present disclosure. Crossbow 100 can be configured in a variety of different ways without departing from the principles of this disclosure.

Figure 1:
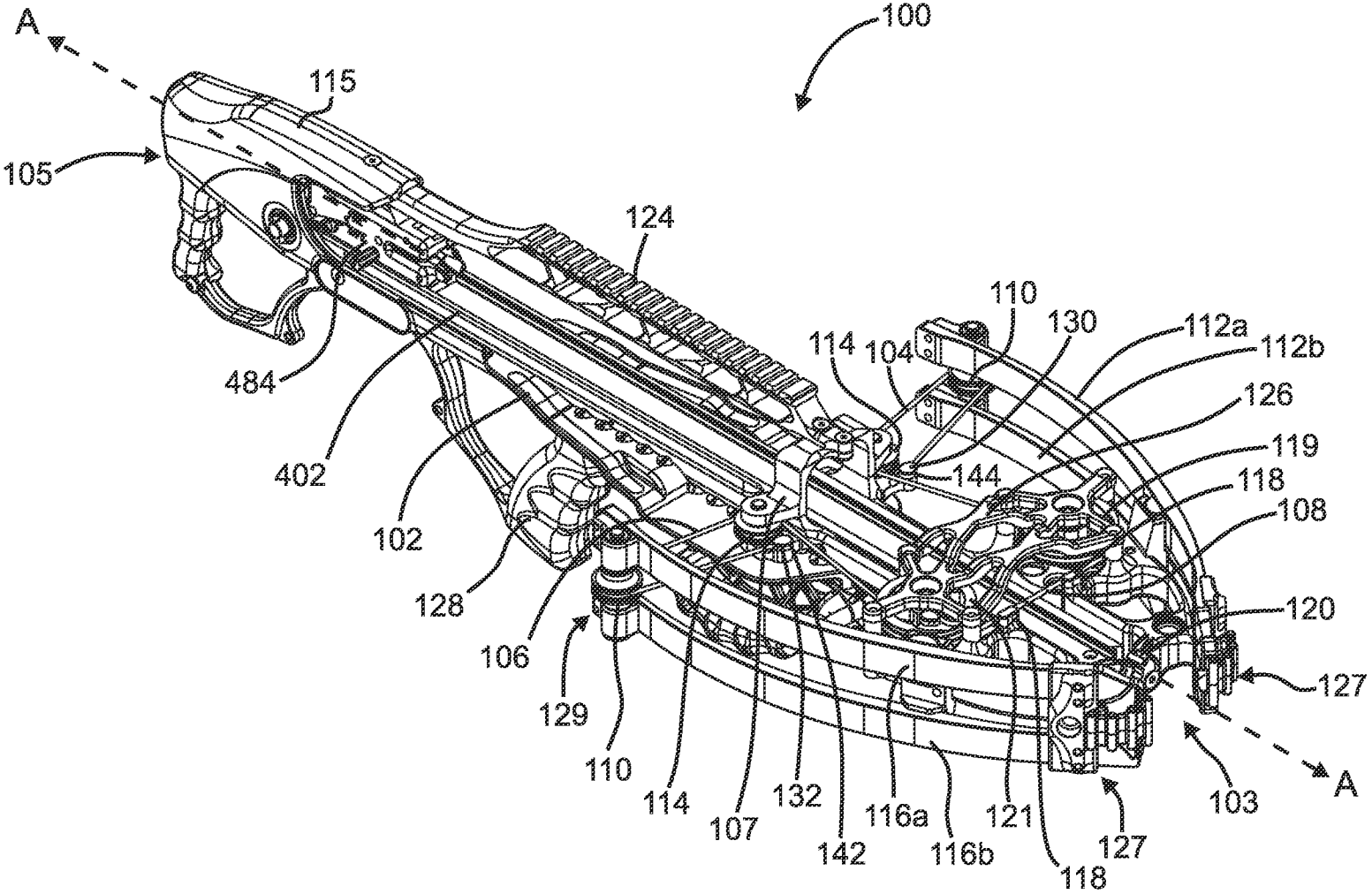
FIG. 1 is a perspective view of an example embodiment of a crossbow according to the principles of the present disclosure, showing the crossbow in an undrawn position.
Figure 2:
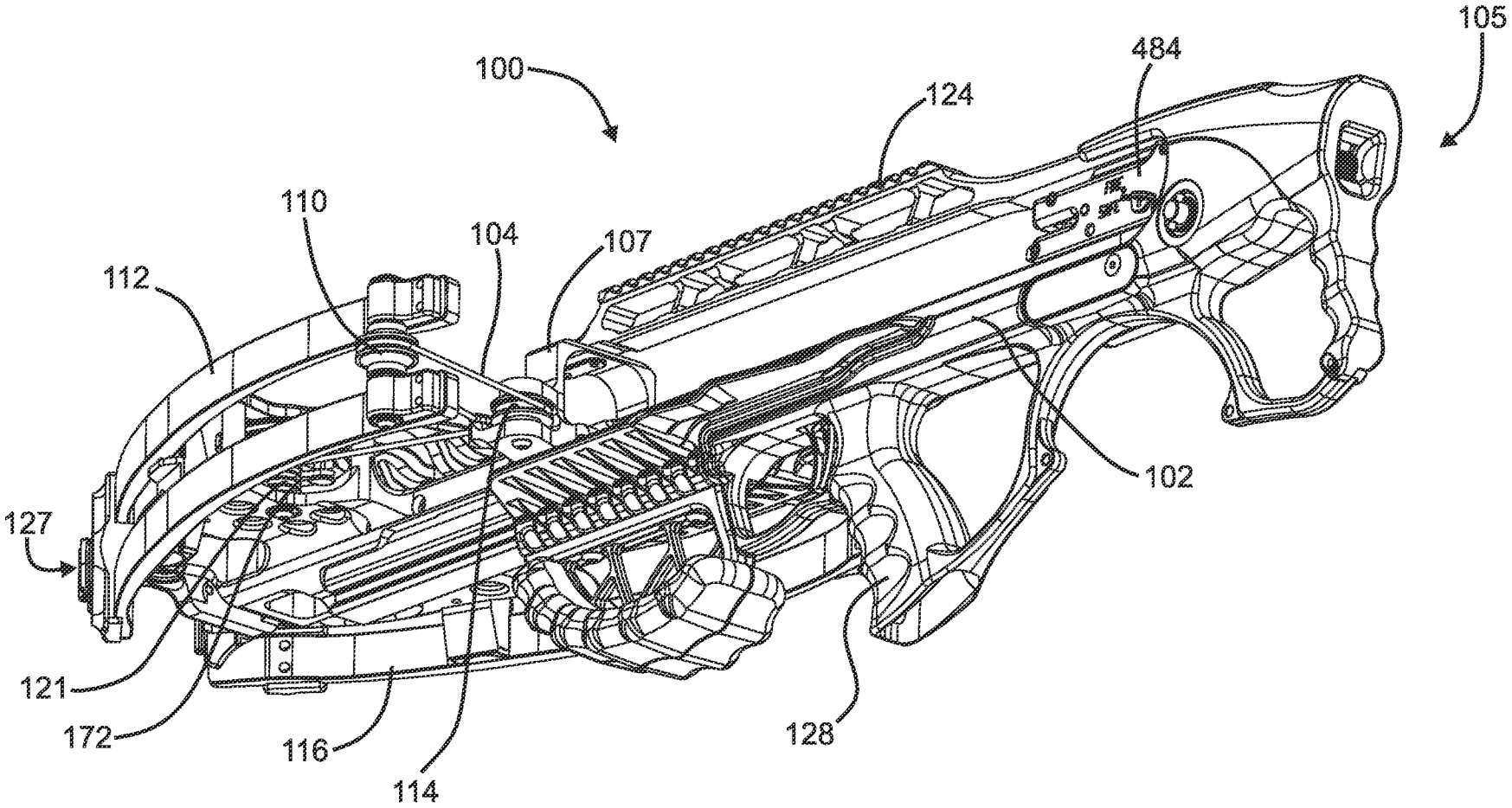
FIG. 2 is another perspective view of the example crossbow of FIG. 1.
Figure 3:
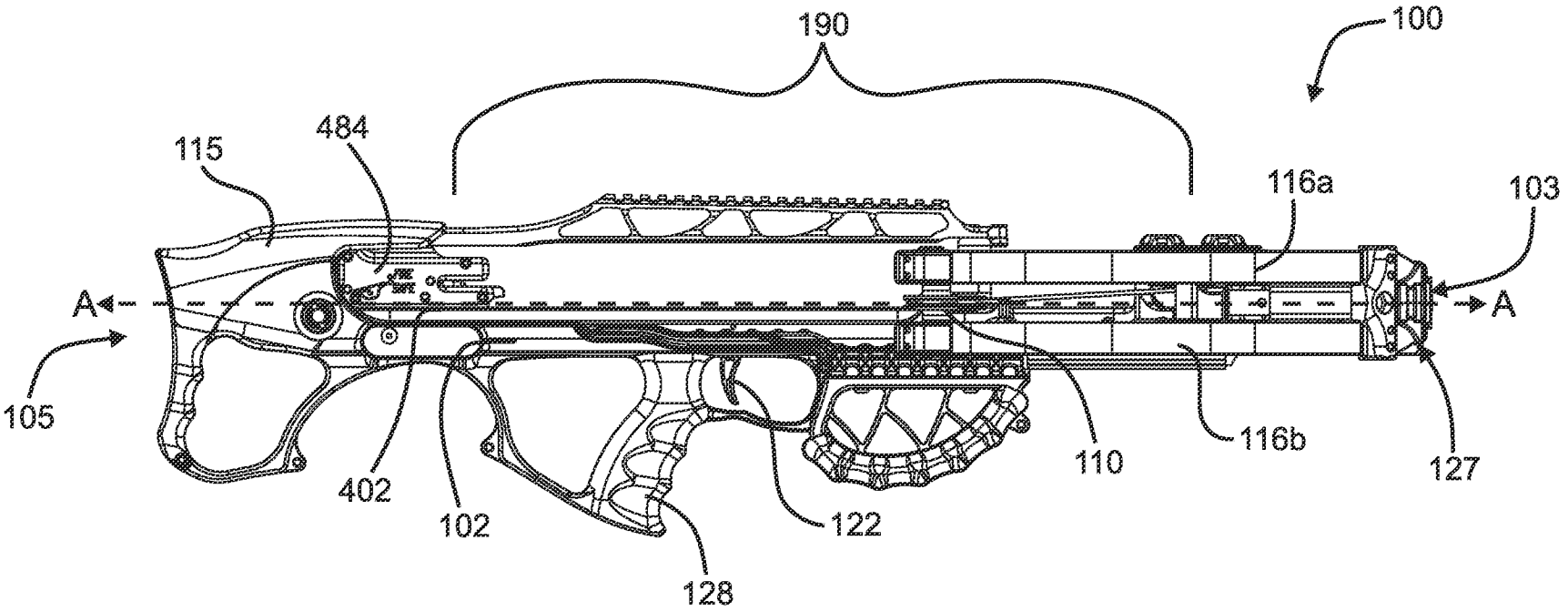
FIG. 3 is a side view of the example crossbow of FIG. 1.
Figure 4:
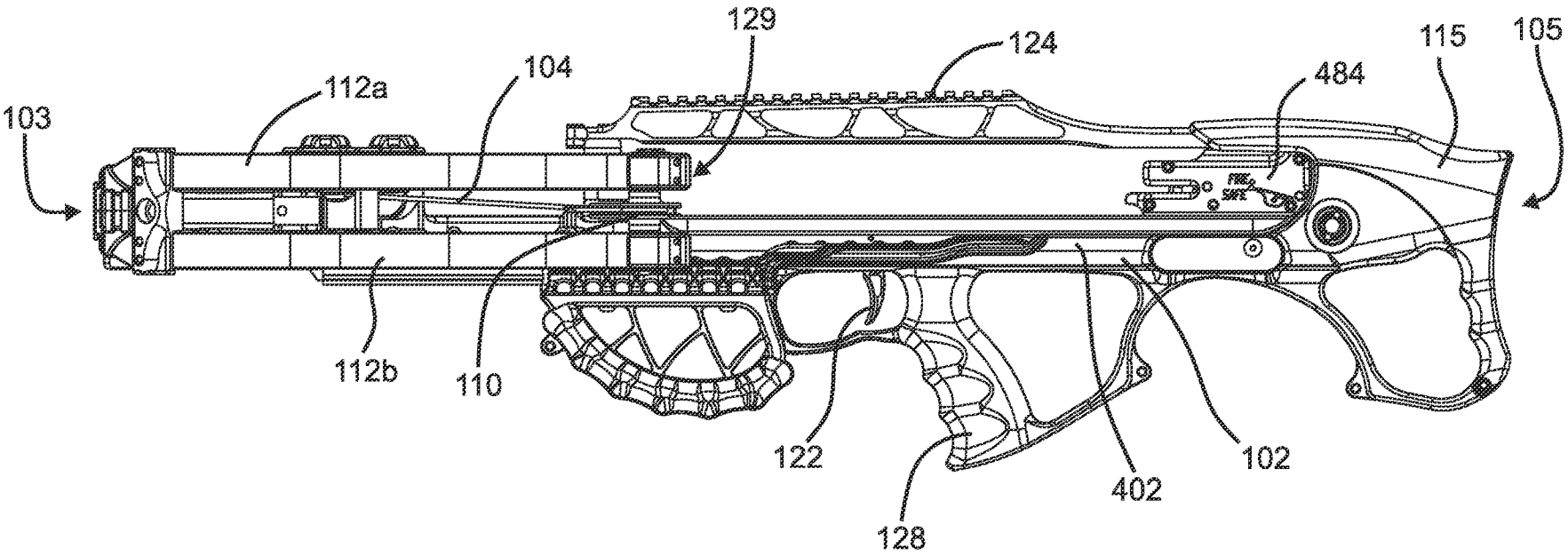
FIG. 4 is another side view of the example crossbow of FIG. 1.
Figure 6:
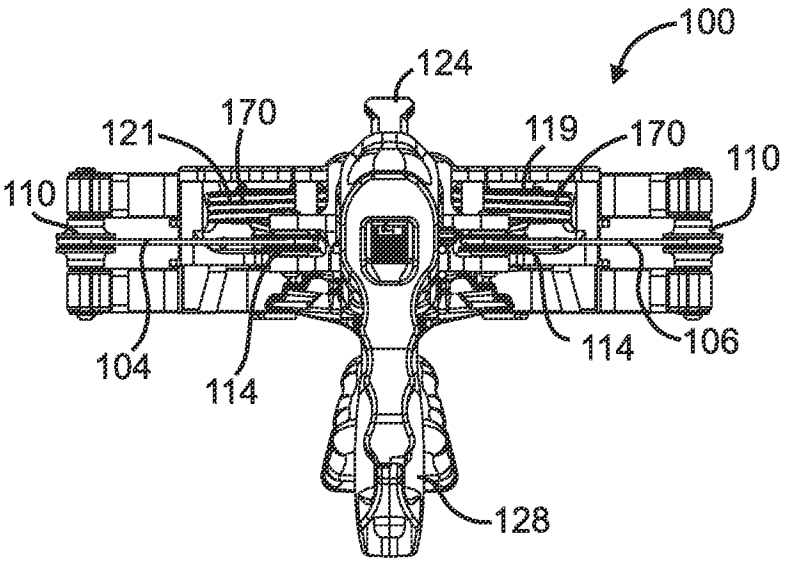
FIG. 6 is a rear view of the example crossbow of FIG. 1.
Figure 5:
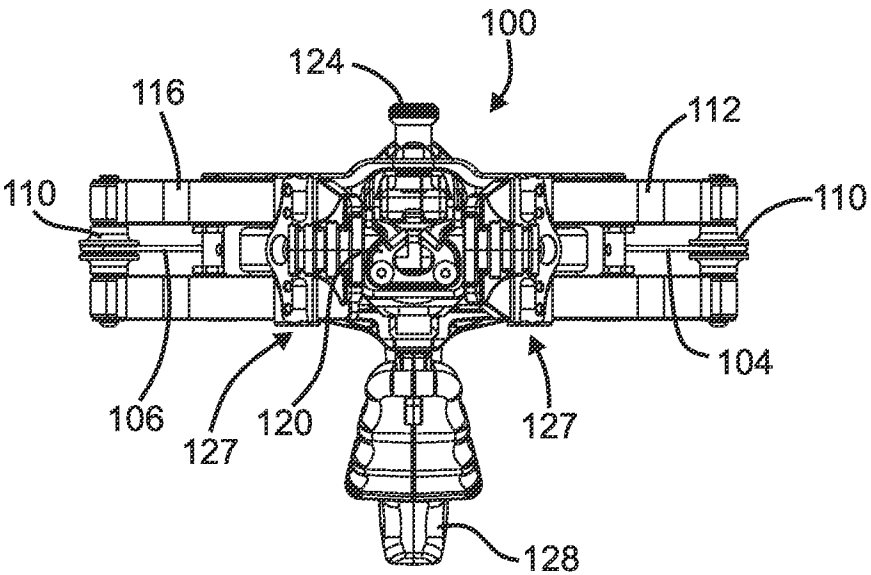
FIG. 5 is a front view of the example crossbow of FIG. 1.
Figure 7:
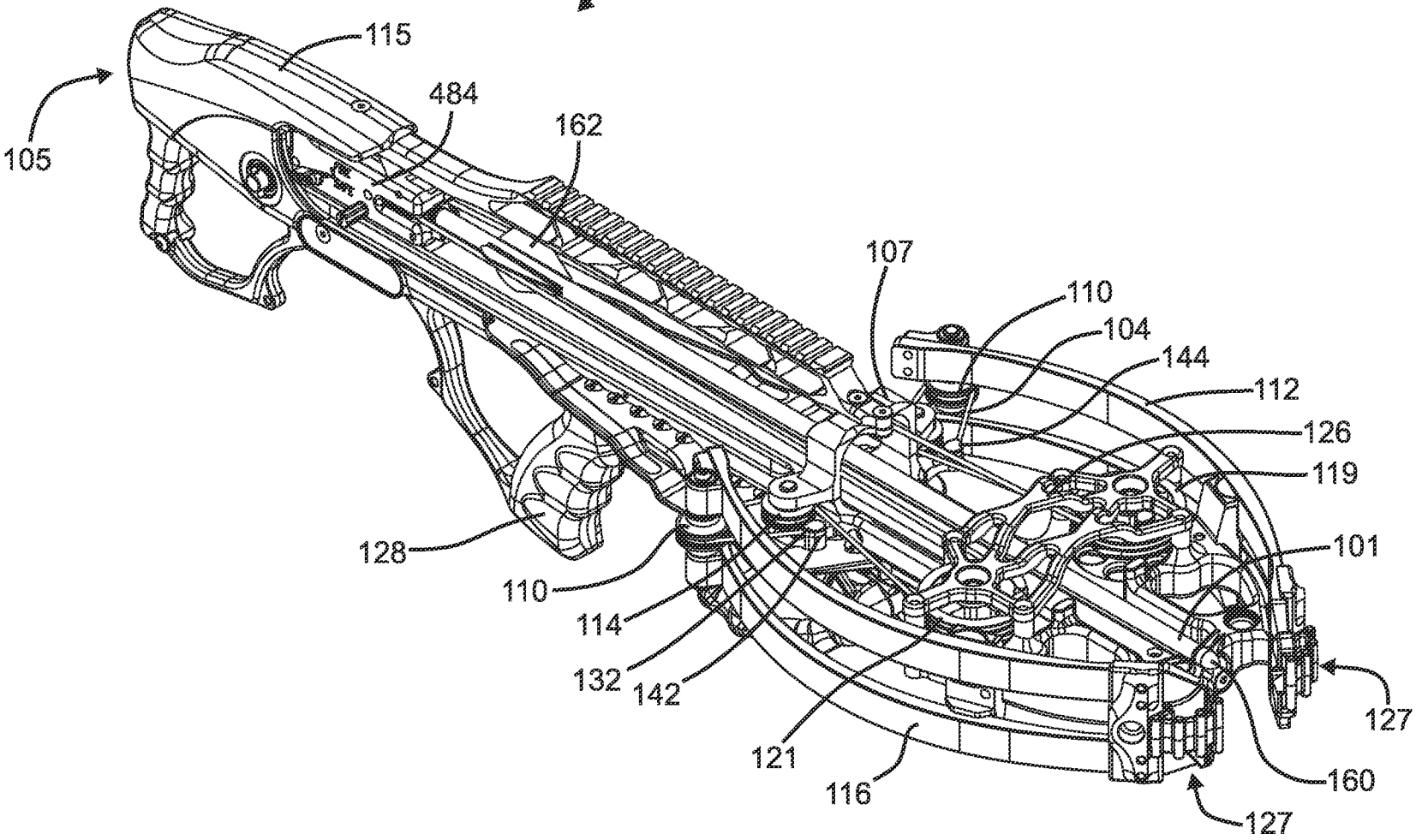
FIG. 7 is another perspective view of the example crossbow of FIG. 1, showing the crossbow in a drawn position.

FIG. 1 shows a perspective view of an example crossbow 100 in an undrawn or "uncocked" position. FIG. 2 shows another perspective view of crossbow 100 in the undrawn position. FIGS. 3 and 4 show side views of the crossbow 100 in the undrawn position. FIGS. 5 and 6 show front and rear views of crossbow 100 the undrawn position. FIG. 7 shows another front perspective view of crossbow 100 in a drawn or "cocked" position.

In the illustrated example, the crossbow 100 includes a frame 102 (including a riser 107), a first power cable 104, a second power cable 106, a drawstring 108, a first flexible limb 112, a second flexible limb 116, a first cam 119, a second cam 121, and a trigger assembly 122. Some embodiments further include a projectile rest 120. Other embodiments include one or more other components, such as described herein.

The example crossbow 100 includes a frame 102. The frame 102 is a main body of the crossbow 100, and is generally formed as a rigid structure that supports other components of the crossbow 100. The frame 102 can be constructed of variety of materials including carbon fiber composite, wood, metal (such as aluminum), plastic, or other suitable materials. In other examples, the frame 102 has a one-piece construction, and in other embodiments the frame 102 has a multiple-piece construction. Frame 102 may include a variety of mounting points (which can be part of one or more accessory mounting rails, etc.) for attaching various modular accessories such as a quiver, a scope, a flashlight, or other attachments.

In some embodiments the frame 102 includes a stock 115 at a rear end 105, or alternatively the stock 115 may be connectable to the frame 102. In some examples, the stock 115 may be integrally formed with frame 102 as a singular unibody component, or may be a separate part that is removable from the frame 102. The stock 115 can be arranged to press against a shoulder or chest of the operator when the crossbow 100 is held in the firing position, such as to help stabilize the crossbow 100 while aiming and shooting. In some examples, crossbow 100 does not include a stock 115 and can be fired like a pistol.

In the embodiment shown, the frame 102 includes the riser 107, and may be formed integral with or be a separate piece attached to the rest of the frame 102. In some embodiments the riser 107 provides mounting locations for various components, including flexible limbs 112, 116 and cams 119, 121. In certain embodiments, riser 107 and frame 102 may be formed as a singular component. The riser 107 can be made of a glass/carbon fiber composite but may alternatively be made of metal (such as aluminum), wood, plastic, or other suitable materials.

The crossbow 100 includes a power source, such as one or more flexible limbs 112, 116. Other power sources can also be used, such as including—but not limited to—spring(s) and/or motor(s). Additionally, some embodiments include multiple power sources, such as a combination of there or other power sources.

In this example, the crossbow 100 includes a power source in the form of first and second flexible limbs 112, 116. The limbs can each be configured with one or more portions. The illustrated example shows the first and second limbs 112, 116 as split limbs including first and second limb portions 112*a*, 116*a*, and 112*b*, 116*b*. Limbs 112, 116 can be formed of one or more portions, including two, three, or more portions.

The first and second limbs 112, 116 are connected to the riser 107 at least at the first ends 127, and have opposite free ends 129 that are free to move relative to the frame 102, and can be loaded with force using the power cables 104, 106.

In certain embodiments, the power cables 104, 106 are coupled to the flexible limbs 112, 116. The power cables 104, 106 can be replaceable, so that they can be replaced when they are worn, for example. In some examples, the crossbow 100 is provided without power cables 104, 106, and the power cable 104 can be subsequently added by a user or technician. The power cables 104, 106 can be constructed of traditional bowstring material such as, but not limited to, composite and/or natural fibers.

In certain embodiments, the crossbow 100 may include additional or fewer power cables without departing from the principles of this disclosure. Example arrangements of the power cables 104, 106 are described in further detail herein, but in some examples the power cables 104 are secured at one end 130 to the frame 102 (e.g., at mounting location 144), and a second end 132 is secured to the first and second cams 119, 121. The power cable can be directed across one or more pulleys, such as pulley 110 at the ends 129 of the limbs, and a pulley 114 coupled to the frame 102.

The crossbow 100 also includes, or is configured to include, a drawstring 108. In some embodiments, the drawstring 108 is connected to and extends between the cams 119, 121, as discussed in further detail herein.

Some embodiments include one or more cams. The example crossbow 100 includes first and second cams 119, 121. In some embodiments the cams 119, 121 include a larger diameter portion 170 and a smaller diameter portion 172. In some embodiments, the larger diameter portion 170 is configured to engage with a portion of the drawstring 108, and the smaller diameter portion 172 is configured to engage with a portion of the first or second power cables 104, 106. The cams 119, 121 can provide at least one of a force reduction and an increase in draw length.

In some embodiments the drawstring 108 and/or power cables 104, 106 are configured to wrap one or more complete rotations around the cams 119, 121, such as in a range from 1 to five rotations. In some embodiments, the cams 119, 121 are multiple-wind cams. A multiple wind cam is one in which at least one (or both) of the drawstring 108 or the power cables 104, 106 wind at least two complete rotations around the cams 119, 121. In some embodiments, the cams 119, 121 are configured to have one or more, two or more, three or more, four or more, or five or more complete rotations of the drawstring 108 and/or the power cables 104, 106 thereon. In some embodiments, the crossbow 100 can include additional or fewer cams without departing from the principles of this disclosure.

As shown in FIGS. 1 and 5, some embodiments of the crossbow 100 include a projectile rest 120 mounted to the front end 103 of the crossbow 100. The crossbow 100 includes an opening 125 arranged along a projectile access A for supporting the projectile 101 therein. In some examples, the projectile rest 120 includes bristles positioned within the opening 125 for supporting the projectile 101. In some examples, the projectile rest 120 can include arms to cradle the projectile 101. The projectile rest 120 can also be built into the frame in some embodiments. The crossbow 100 is configured to propel the projectile 101 along the projectile axis A and out from the front end 103 of the crossbow 100 when the crossbow 100 is fired. In some embodiments the left and right sides of the crossbow 100 are generally symmetrical about the projectile axis A.

In certain embodiments, crossbow 100 may include an accessory rail 124 to which a sighting apparatus or other accessories may be attached. The crossbow 100 can include a plurality of accessory rails 124. In some examples, the accessory rail 124 is a picatinny rail. In some examples, the accessory rail 124 is configured to receive a sighting apparatus, such as a scope (not shown). In some examples, one of the accessory rails 124 is configured to receive a lighting device, such as a flashlight. In some examples, one of the accessory rails 124 is configured to receive a quiver.

The grip 128 provides a handle for the crossbow 100. A user can hold onto the grip 128 when carrying, aiming, and shooting the crossbow 100. The grip 128 can be held by the user's hand, including when operating the trigger assembly 122. The grip 128 assists the user in stabilizing the crossbow 100 during firing and handling. In some embodiments, the grip 128 is part of the frame 102. In some embodiments the grip is mounted to the frame. In some embodiments, the crossbow 100 has a plurality of grips 128.

FIG. 7 is a perspective view of the crossbow 100 in the drawn position. As shown, the crossbow 100 can fire a projectile 101, such as an arrow. One example of an arrow is a bolt. In certain embodiments, projectile 101 is an arrow with a pointed tip 160 and fletching 162 to help stabilize the projectile as it moves through the air when the projectile is fired from the crossbow 100. The arrow can include a removable tip, and the tip can be a broadhead or target tip, for example, or a variety of other possible tips. As shown, when the crossbow 100 is drawn, the power cables 104, 106 pull on the flexible limbs 112, 116 and cause the flexible limbs 112, 116 to bend toward the projectile axis A, thereby loading the limbs. In the embodiment shown, first ends 130, 132 of power cables 104, 106 are attached to opposite sides of the frame 102, such as at mounting locations 142, 144. Other configurations can be used in other embodiments.

In this example, each flexible limb 112, 116 is coupled to a power cable 104, 106 and attached to riser 107 at a first end 127. Limb pivots 113 are positioned between the first ends 127 and second ends 129 of the flexible limbs 112, 116. In the embodiment shown, the limbs 112, 116 are elastic and spring-like in nature. In some embodiment the limbs 112, 116 are made of a glass/carbon fiber composite, but any other suitable material may be used without departing from the principles of this disclosure.

Limbs 112, 116 extend in an outward direction from the projectile axis A and in a rearward direction toward the rear end 105 of the crossbow 100. The limbs 112, 116 are positioned at either side of the projectile axis A such that the projectile 101 passes between the limbs 112, 116 when the crossbow 100 is fired.

In another possible embodiment, the limbs 112, 116 extend in an outward direction from the projectile axis A and/or in a forward direction toward the front end 103 of the crossbow 100. In some examples, the limbs 112, 116 extend in an upward direction from projectile axis A and/or in a forward direction toward the front end 103 of the crossbow 100. In some examples, the limbs 112, 116 extend in an upward direction from projectile axis A and/or in a rearward direction toward the rear end 105 of the crossbow 100. Limbs 112, 116 may be positioned in a variety of different ways relative to the projectile axis A without departing from the principles of this disclosure.

In some embodiments, crossbow 100 has three separate cables—two identical power cables 104, 106 and a drawstring 108—coupled together by the cams 119, 121. The cams 119, 121 are rotatably attached to the frame 102, such as to the riser 107, and positioned on opposite sides of the projectile axis A. A top bridge 126 is attached to the riser 107 in some embodiments, and extends above and between the cams 119, 121 to provide added support and rigidity to the system. In particular, the top bridge 126 helps prevent the cams 119, 121 from shifting toward the projectile axis A. In one example the top bridge 126 is made of carbon reinforced composite, but other suitable materials may alternatively be used.

As shown, each of the cams 119, 121 includes a larger diameter portion 170 and a smaller diameter portion 172. In the embodiment shown, the larger diameter portions 170 and the smaller diameter portions of cams 119, 121 have a substantially circular cross-sectional shape (e.g., as viewed from the top or the bottom in the configuration shown in FIG. 7). In certain embodiments, each of the cams 119, 121 may optionally include a flat spot at either or both of the larger diameter portion 170 and the smaller diameter portion 172, that may be a zero reference at rest, which is used to reference or zero the cam.

In some embodiments the larger diameter portion 170 and the smaller diameter portion 172 of cams 119, 121 are coaxial and, in some embodiments, are integrally formed as a one-piece component. The smaller diameter portion 172 provides an anchor for the power cable 104, 106, and the drawstring 108 extends between the larger diameter portions 170 of cams 119 and 121. In some embodiments both of the smaller diameter portions 172 and the larger diameter portions 170 include helical grooves 174 that guide the power cables 104, 106 and the drawstring 108 as they wind around the respective portions of the cams 119, 121. In the embodiment shown, the diameters of power cables 104, 106 and the drawstring 108 are the same, so the helical grooves 174 are the same size, whether they are on the larger diameter portion 170 or smaller diameter portion 172. In other embodiments, however, the power cables 104, 106 and the drawstring 108 may differ in diameter. As such, helical grooves 174 may vary in size to accommodate cables and drawstrings of different diameters.

Figure 18:
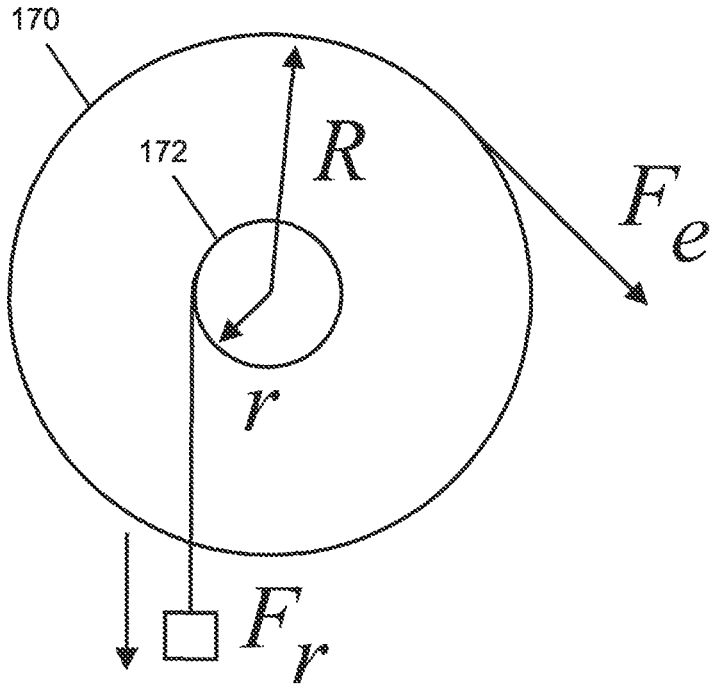
FIG. 18 is a diagram illustrating mechanical advantage principles.
Figure 19:
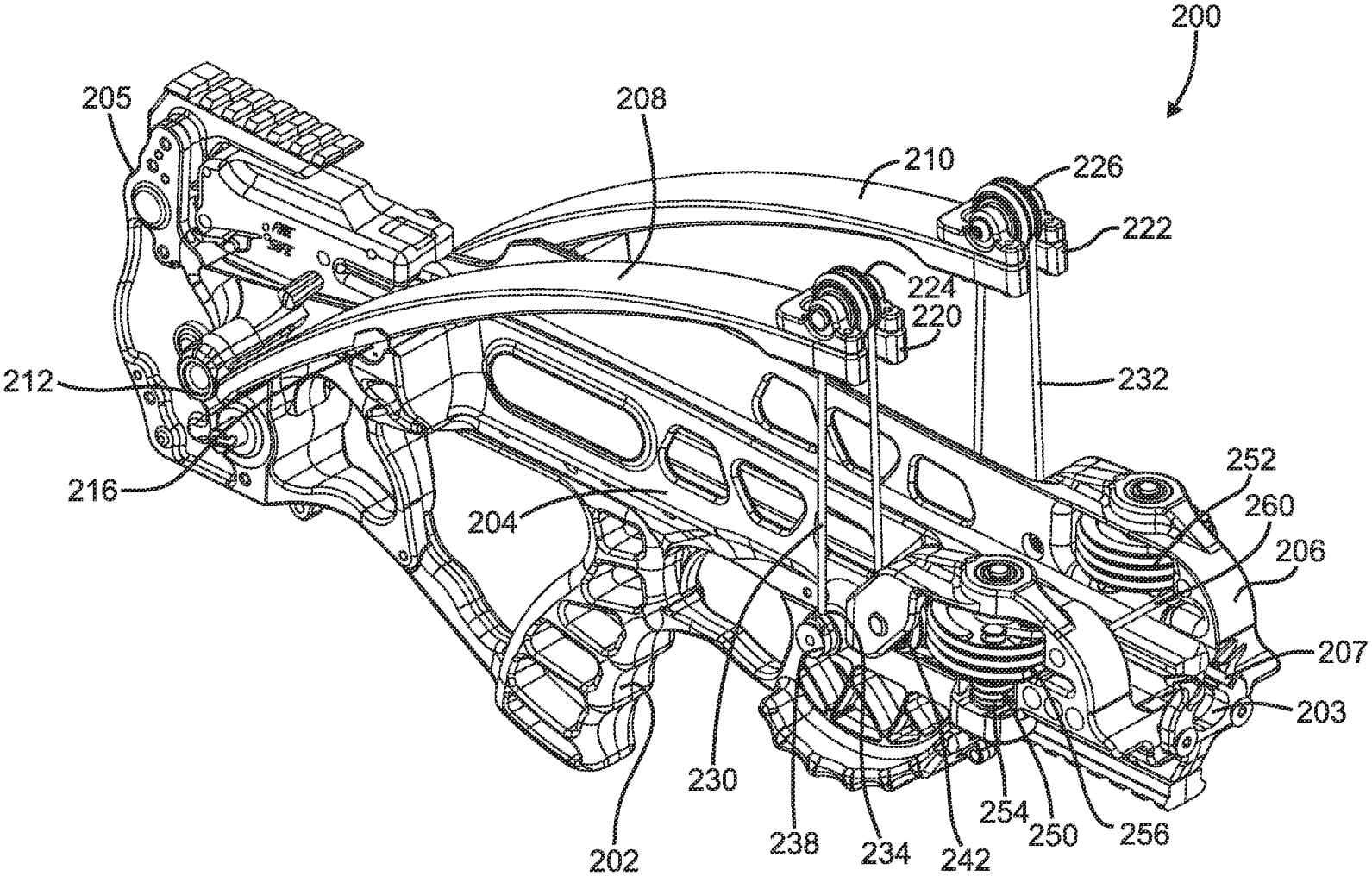
FIG. 19 is a perspective view of one embodiment of a crossbow according to the principles of the present disclosure, showing the example crossbow in an undrawn position.
Figure 20:
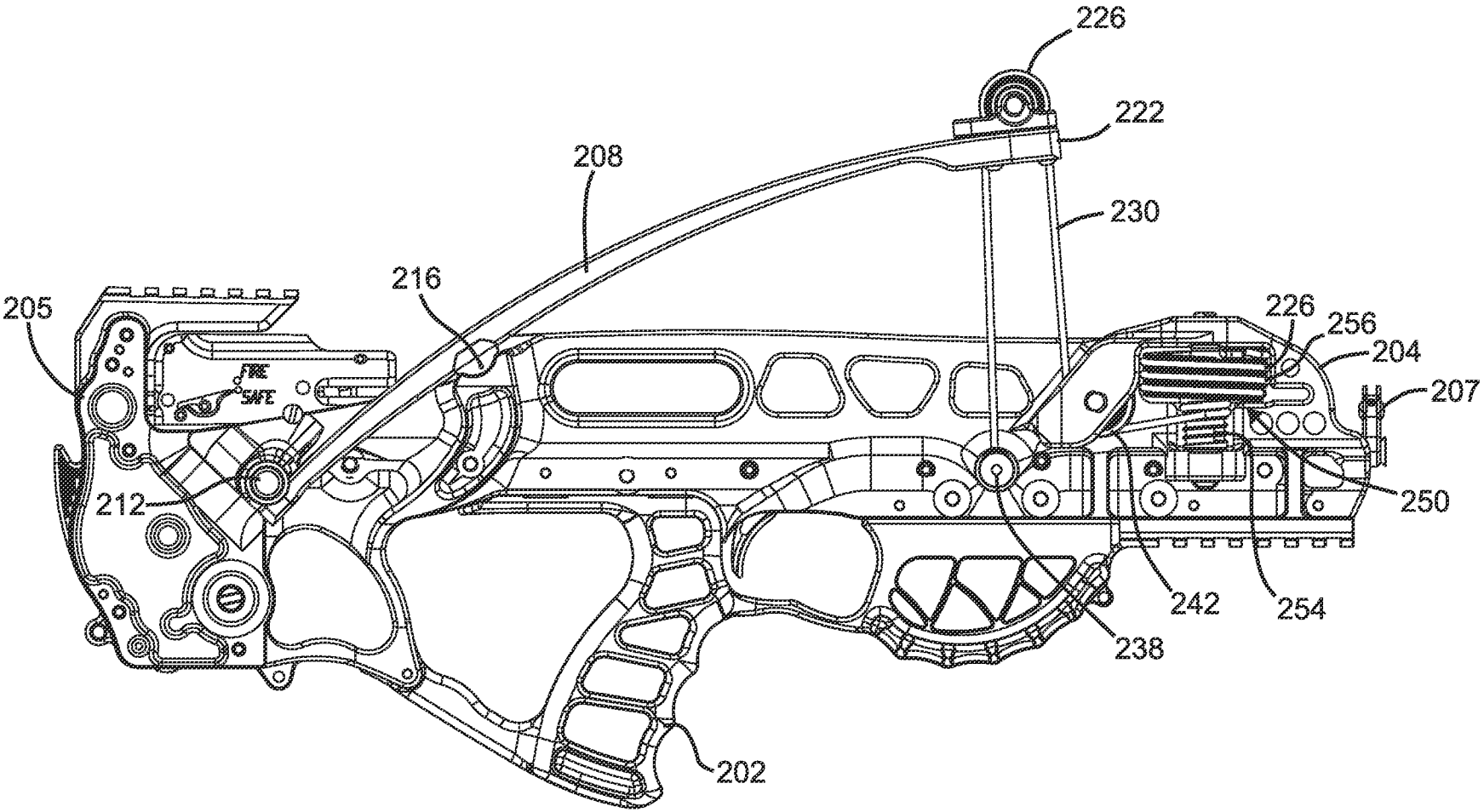
FIG. 20 is a side view of the example crossbow of FIG. 19, showing the crossbow in a undrawn position.
Figure 21:
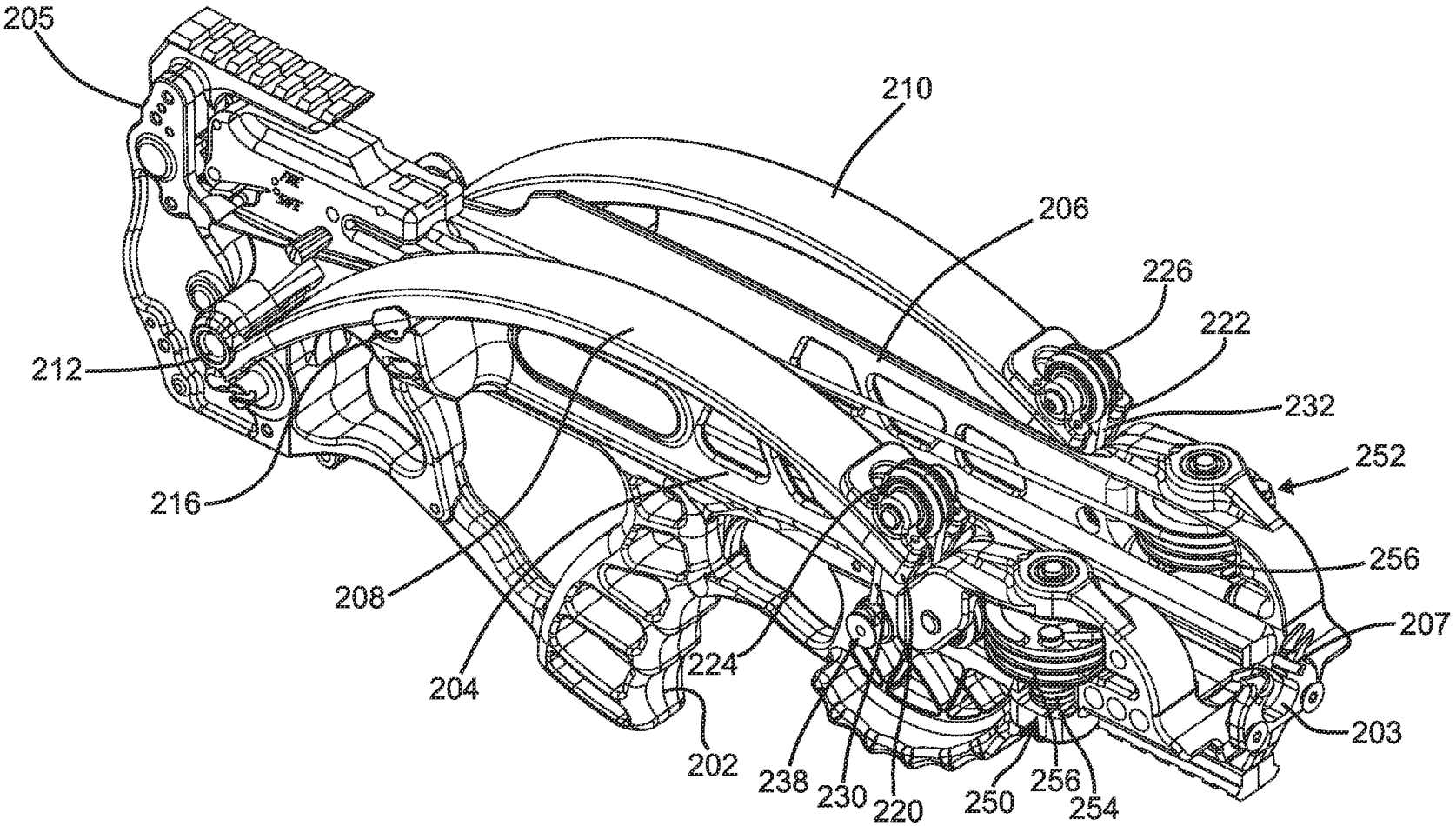
FIG. 21 is another perspective view of the example crossbow of FIG. 19, showing the crossbow in a drawn position.

In some embodiments, the cams 119, 121 provide mechanical advantage and increased draw length, as illustrated in FIG. 18. The smaller diameter portion 172 and the larger diameter portion 170 rotate at the same rate and complete one full rotation in the same period of time. However, due to the size difference in the radius of the larger diameter portion 170 and smaller diameter portion 172, the distance the surfaces of the two portions rotate through is different. A mathematical equation for the ideal mechanical advantage is IMA=R/r, with R=radius of the larger diameter portion 170 and r=radius of the smaller diameter portion 172. Of course, in the real world some of the advantage is lost due to the friction of the system, but it is sufficient to illustrate the principle as shown in FIG. 18. The mechanical advantage of the cam 119, 121 can be selected by choosing the radii R and r, and may vary as desired. Additionally, due to the diameters, a relatively small distance of power cable 104, 106 that can be wrapped around the smaller diameter portion 172, can equate to a much longer distance of drawstring 108 that can be wrapped around the larger diameter portion 170. Accordingly, smaller movements of the limbs (which is even further reduced by the pulley 110 at the ends 129 of the limbs 112, 116), can equate to a relatively much longer distance movement of the drawstring 108, thereby greatly increasing the draw length and power stroke of the crossbow 100 as compared with a crossbow having the same amount of limb deflection without including such features.

In some embodiments, the power cable pulleys 110 are positioned near the ends of flexible limbs 112, 116 and can freely rotate to guide the power cables 104, 106 as they extend from their mounting locations 142, 144 on the riser 107. The power cables 104, 106 extend from mounting locations 142, 155 around the power cable pulleys 110 back toward the riser 107. This configuration provides a force magnification (mechanical advantage) while reducing limb deflection. Additional pulleys can be provided in some embodiments to further increase mechanical advantage and draw length or reduce the amount of limb deflection.

In some embodiments each of the power cables 104, 106 is routed around a pulley 114—which freely rotates—and onto the smaller diameter portion 172 of the cam 119, 121. The pulley 114 is mounted to the frame 102, such as a portion of the riser 107. The pulley 114 can be referred to as a riser pulley 114 in some embodiments.

As shown in FIGS. 9-12, when the crossbow 100 is drawn—with drawstring 108 cocked and ready to fire—the power cables 104, 106 are wound around the smaller diameter portions 172 of the cams 119, 121 at least one complete rotation. In some embodiments, the cams 119, 121 are multiple-wind cams, in which the power cables 104, 106 are wound at least two, at least three, at least four, or at least five complete rotations around the smaller diameter portions 172 of the cams 119, 121. As drawstring 108 is drawn, the drawstring 108 unwinds from the larger diameter portions 170 of the cams 119, 121. The unwinding of larger diameter portions 170 causes the cams 119, 121 to rotate, thereby causing power cables 104, 106 to wind around smaller diameter portions 172. In some embodiments, once crossbow 100 is fully drawn, power cables 104, 106 wind approximately three complete rotations around the smaller diameter portions 172. In certain embodiments, the power cables 104, 106 wind from one to five (or more) complete rotations around the smaller diameter portions 172. Even though the drawstring 108 and power cables 104, 106 are both selectively wound around their respective portions of the cams 119, 121, the power stroke 190—the distance from the undrawn position of drawstring 108 to the drawn position of drawstring along projectile axis A—is significantly longer than the deflection distance 192—how far the first and second flexible limbs 112, 116 bend when drawn. The difference in power stroke 190 and deflection distance 192 is determined by the difference in radii of the larger diameter portion 170 and smaller diameter portion 172.

Figure 12:
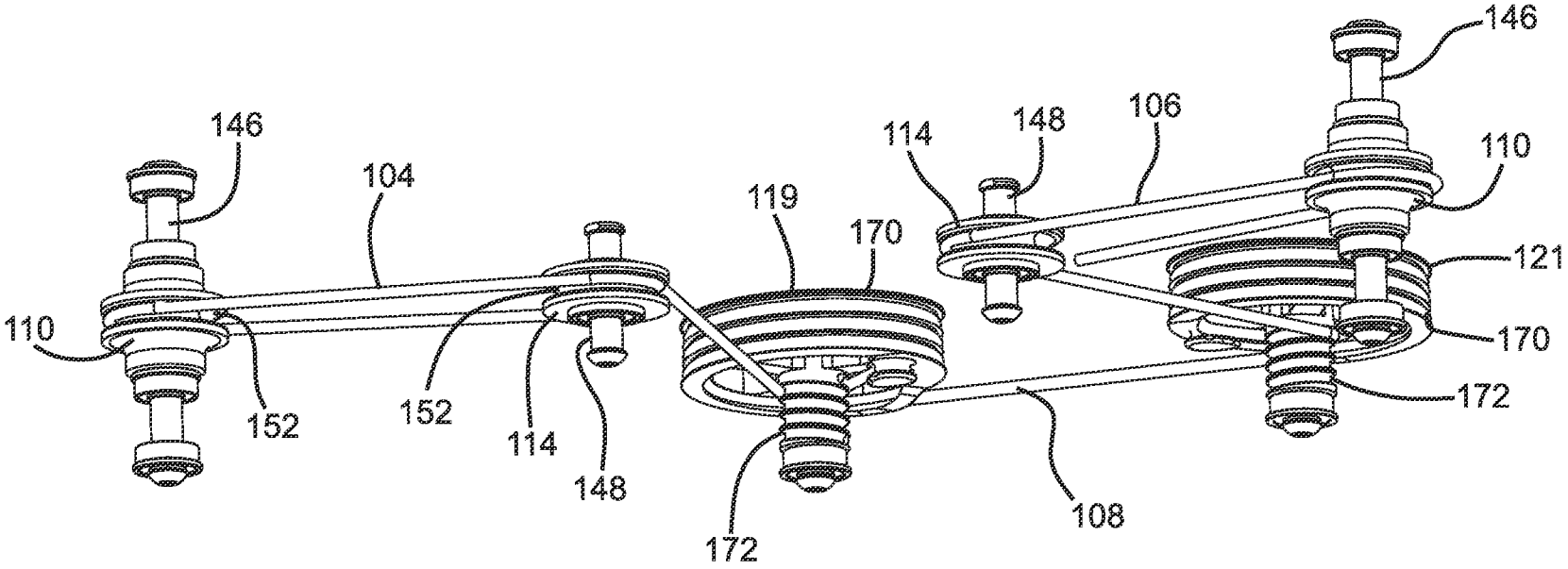
FIG. 12 is another rear bottom perspective view of the example pulley system for the crossbow of FIG. 1, shown in the undrawn position.

As shown in FIG. 12, when crossbow 100 is undrawn—with drawstring 108 uncocked—power cables 104, 106 are attached to the smaller diameter portions 172 but are not significantly wound around the smaller diameter portions 172. In certain embodiments, power cables 104, 106 may be wound around the smaller diameter portions 172 any suitable amount without departing from the principles of this disclosure. Meanwhile, when the crossbow 100 is undrawn, drawstring 108 is attached to larger diameter portions 170 and wound around them at least one complete rotation. In the embodiment shown, drawstring 108 is wound around larger diameter portions 170 approximately three complete rotations. In certain embodiments, drawstring 108 may be wound around larger diameter portions 170 any suitable number of rotations without departing from the principles of this disclosure. In certain embodiments, power cables 104, 106 wind between approximately one and five complete rotations around the smaller diameter portions 170, and the drawstring 108 winds between approximately one and five complete rotations around the smaller diameter portions 172. In some embodiments, power cables 104, 106 wind at least one, at least two, at least three, at least four, or at least five complete rotations around the smaller diameter portions 170 of the cams 119, 121. In some embodiments, the drawstring 108 winds at least one, at least two, at least three, at least four, or at least five complete rotations around the larger diameter portions 170 of the cams 119, 121.

The mechanical advantage between the larger diameter portions 170 and the smaller diameter portions 172 reduces the draw weight necessary to draw the drawstring 108 to the cocked position. To draw crossbow 100, it is stabilized and drawstring 108 is pulled toward the rear end 105 of the crossbow 100. In some embodiments a cocking system is used to draw the drawstring 108 from an uncocked position to a cocked position. One example of a cocking system in accordance with the present disclosure is described in U.S. Pat. No. 10,077,965, the entirety of which is incorporated herein by reference for all purposes. In certain alternative embodiments, an arming device, the user's hand and arm, or other like mechanisms can be used to draw the drawstring 108.

Figure 13:
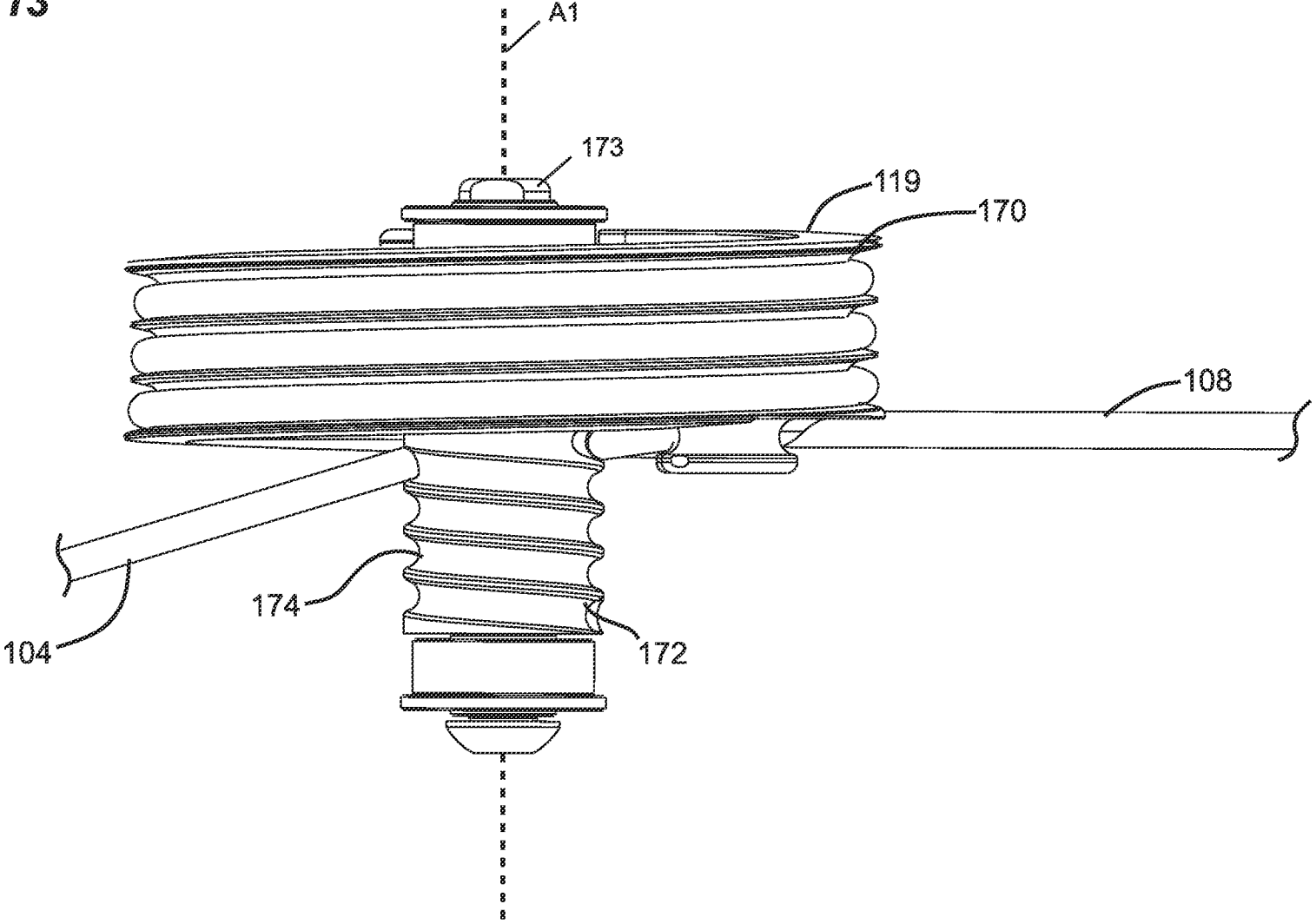
FIG. 13 is a detail view of an example multiple-wind cam for the crossbow of FIG. 1, showing a drawstring wound around an upper pulley and a power cable attached to a lower pulley.
Figure 14:
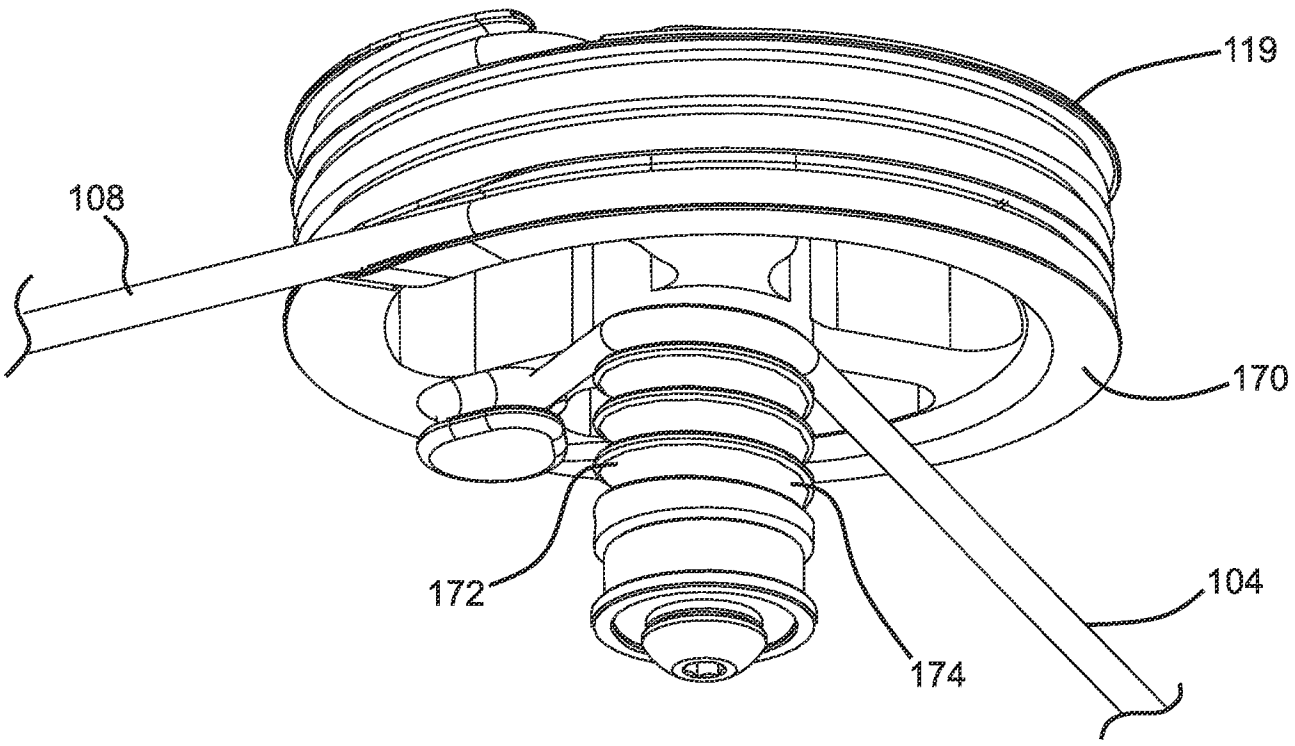
FIG. 14 is a bottom detail perspective view of the example multiple-wind cam of FIG. 13.

FIGS. 13-16 show an example of the cam 119 in greater detail, with reference to a particular example involving a multiple-wind cam, and more particularly to a triple-wind cam. FIGS. 13-14 show multiple-wind cam 119, drawstring 108, and power cable 104. As shown, drawstring 108 is wrapped around larger diameter portion 170 a plurality of rotations, while power cable 104 is attached to smaller diameter portion 172 but wraps around smaller diameter portion less than one full rotation. In the position shown in FIGS. 13-14, the crossbow 100 is in the undrawn position.

As shown in FIG. 13, the cam 119 (and similarly cam 121) can be mounted to the frame 102 (such as the riser 107) with an axle 173. The axle 173 extends through the cam 119 (or 121) and supports the cam 119 (or 121) as it rotates with respect to the frame 102 and riser 107. The axle and cams 119 (or 121) have an axis of rotation A1. In this example, the axis of rotation is vertical when the crossbow 100 is oriented such that the grip 128 is downward and the projectile axis A (FIG. 1) is horizontal.

Figure 15:
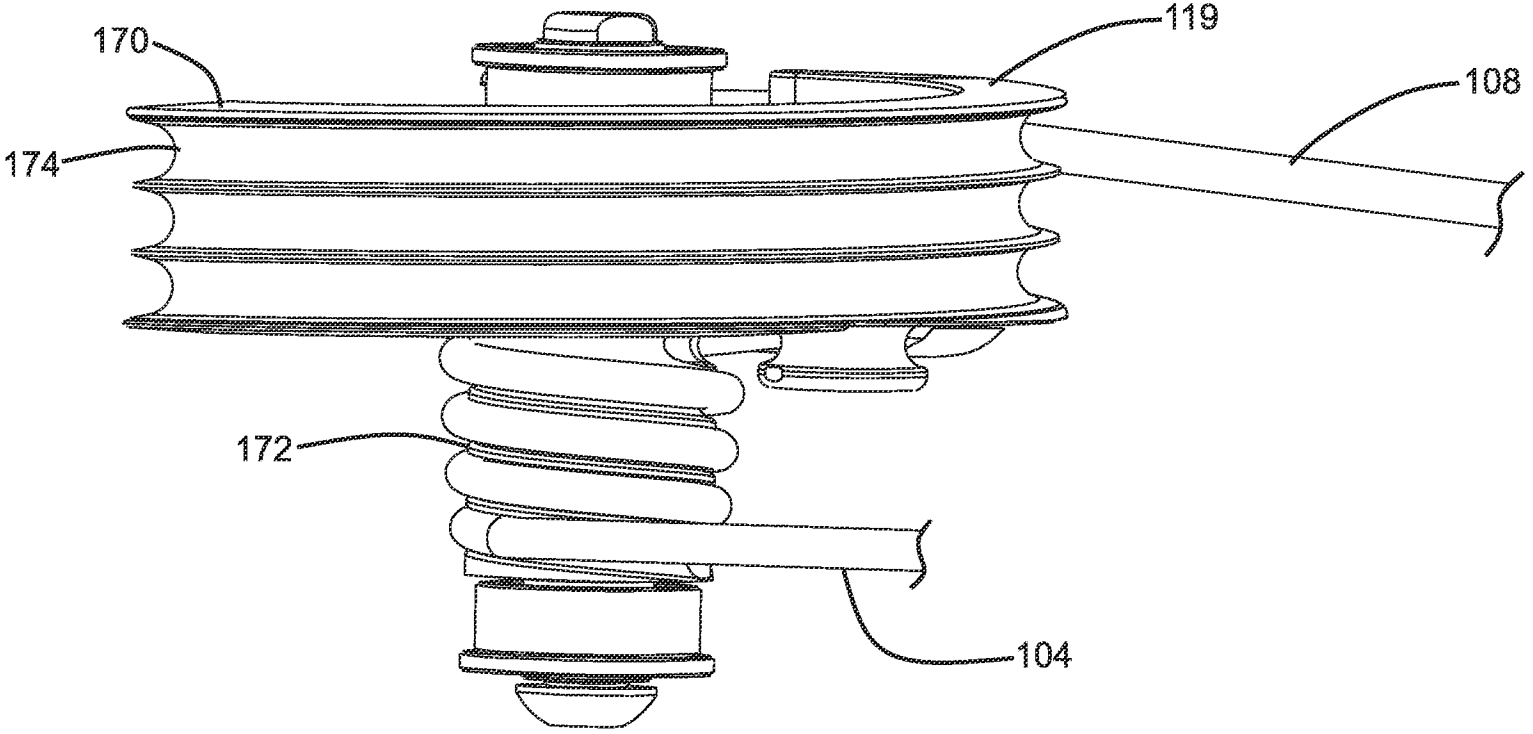
FIG. 15 is another detail view of the example multiple-wind cam of FIG. 13, showing the drawstring attached to the upper pulley and the power cable wound around the lower pulley.
Figure 16:
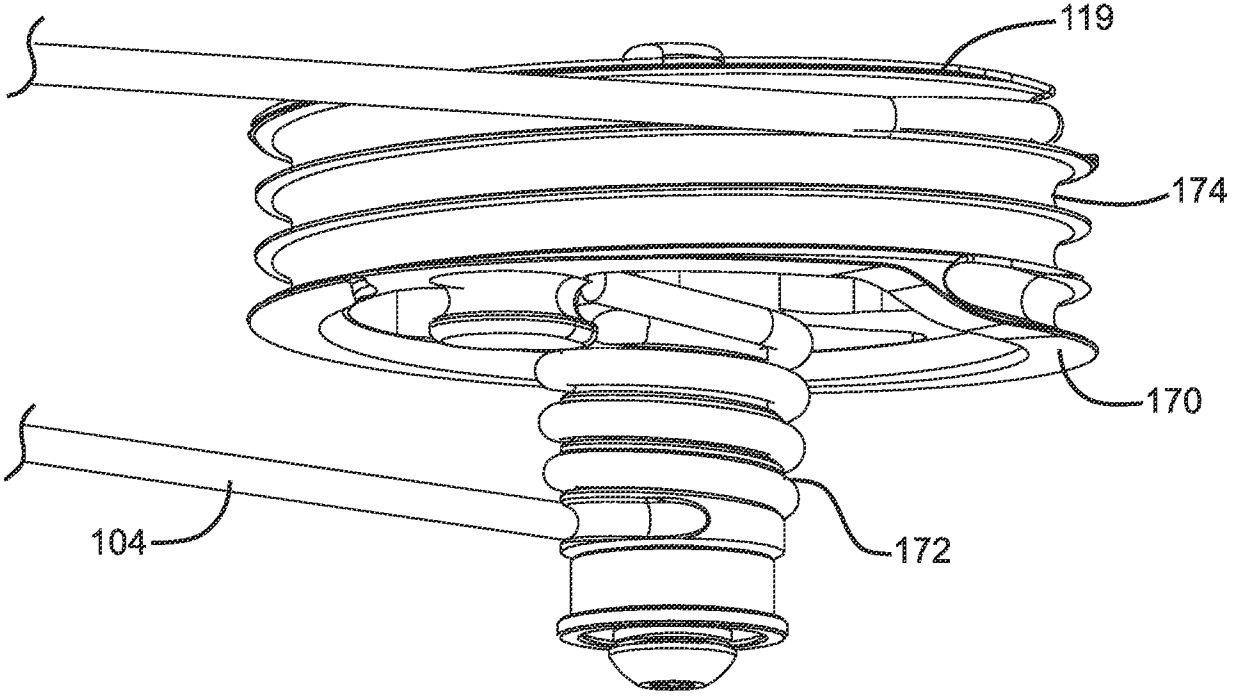
FIG. 16 is another bottom detail perspective view of the example multiple-wind cam of FIG. 15.
Figure 17:
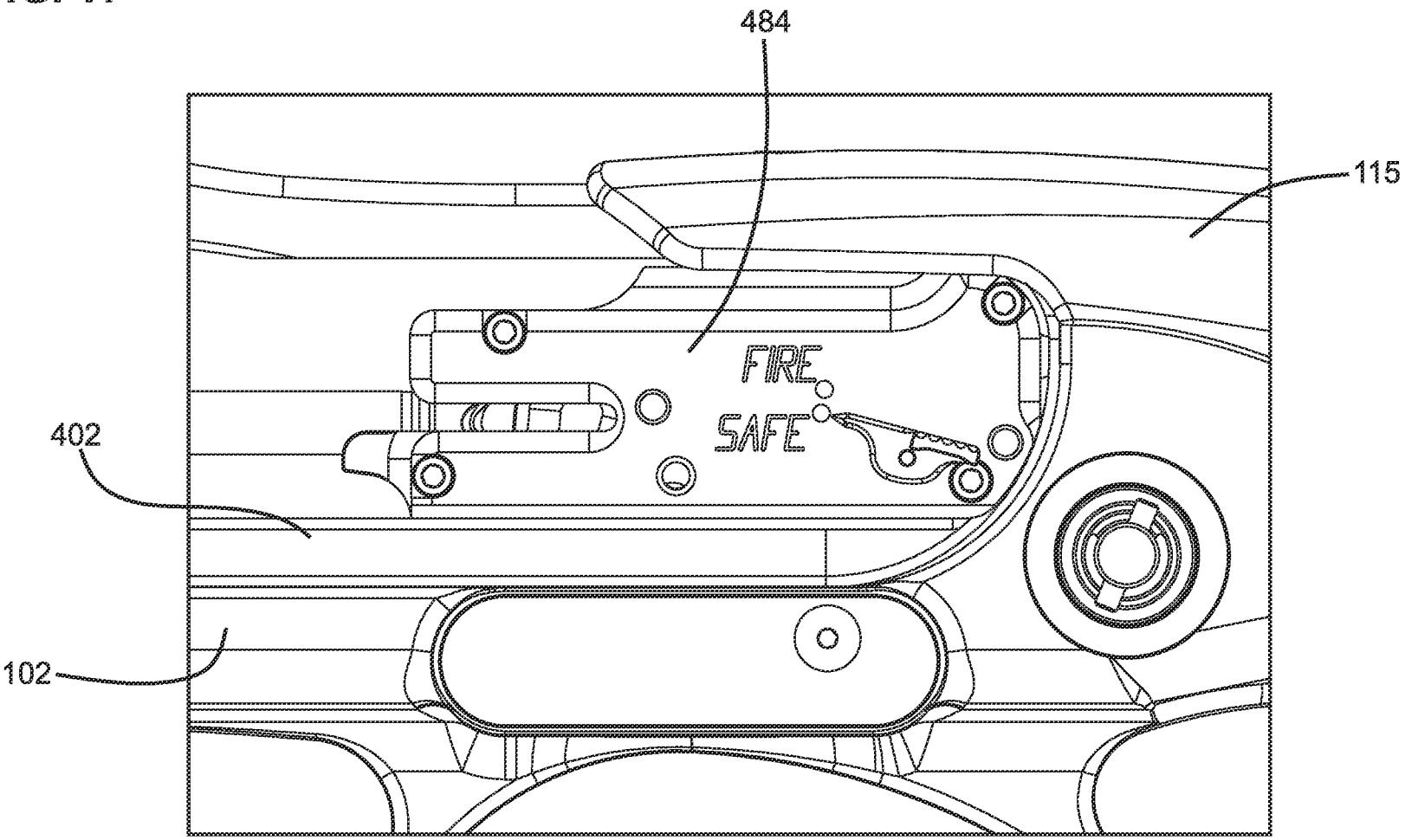
FIG. 17 is a side detail view of an example projectile carrier in accordance with the principles of this disclosure.

Similarly, FIGS. 15-16 show multiple-wind cam 119, drawstring 108, and power cable 104. As shown, drawstring 108 is wrapped around larger diameter portion 170 less than one full rotation, while power cable 104 is wrapped around smaller diameter portion 172 a plurality of rotations. In the position shown in FIGS. 15-16, the crossbow 100 is in the drawn position.

As shown in FIGS. 1-4, 7, and 17, the example crossbow 100 includes a cocking system that includes a drawstring carrier 480. The drawstring carrier 480 slides along a drawstring carrier guide 402 toward the riser 107, and toward the front end 103 of the crossbow, to engage the drawstring 108 in the undrawn position. That is, the drawstring carrier 480 is slidably attached to the drawstring carrier guide 402 and moves in a single degree of freedom along the projectile axis A. The engagement of the drawstring carrier 480 with the guide 402 substantially prevents the drawstring carrier 480 from moving in any other direction relative to the drawstring carrier guide 402 and the riser 107. As shown, in some embodiments the drawstring carrier 480 cannot be removed from the drawstring carrier guide 402 without disassembling the crossbow 100 or the drawstring carrier 480. An example of the drawstring carrier 480 is a movable latch. The drawstring carrier 480 is configured to release the drawstring when the trigger of the trigger assembly 122 is actuated.

The cocking mechanism 484 retracts the drawstring carrier 480 to the drawn position illustrated in FIG. 7. The crossbow 100 includes a positive stop (e.g., the stock 115) for the drawstring carrier 480 that prevents the drawstring 108 from being retracted beyond the drawn configuration. In some embodiments cocking of the crossbow 100 can be accomplished using a tool, such as a removable crank. A motorized cocking mechanism 484 can also be provided in some embodiments.

After the drawstring carrier 480 captures the drawstring 108, the cocking mechanism 484 is used to return the drawstring carrier 480 toward the stock 115 and into engagement with trigger assembly 122. After drawstring carrier 480 has drawn the drawstring 108 and is engaged with trigger assembly 122, it is almost ready to fire. Next, a user loads a projectile 101 onto crossbow 100 along the projectile axis A and engages the projectile 101 with the drawstring 108 (e.g. by clipping a nock of an arrow onto the drawstring 108), while the drawstring 108 remains captured by the drawstring carrier 480.

Once projectile 101 is engaged with drawstring carrier 480, it is ready to fire. A user may actuate the trigger assembly 122 to fire the crossbow 100. The trigger assembly 122 is in communication with the cocking mechanism 484 so that upon activation of the trigger assembly 122 when firing (e.g., pulling the trigger toward the rear end 105 of the crossbow 100), the trigger assembly 122 moves portions of the cocking mechanism 484 and the drawstring 108 is released and is rapidly propelled toward the front end 103 of the crossbow 100 by movement of the drawstring 108 caused by the release of force from the limbs 112, 116. In some examples, the trigger assembly 122 includes a safety and/or anti-dry fire protection. As the drawstring 108 travels toward the front end 103 it carries the projectile 101 with it. The projectile is then released and fired from the front end 103 of crossbow 100. In certain embodiments string stops 118 (FIGS. 1, 7-8) are provided on either side of projectile axis A and positioned between the cams 119, 121 and the front end 103 of crossbow 100. String stops 118 extend from riser 107 above and adjacent to the projectile axis A and provide a positive stop to the drawstring 108 as it travels toward the front end 103 of crossbow 100. In certain embodiments, string stops 118 are integrally formed in frame 102. In certain other embodiments, string stops 118 may be separate components that may be removably attached to either riser 107 or frame 102.

Figure 8:
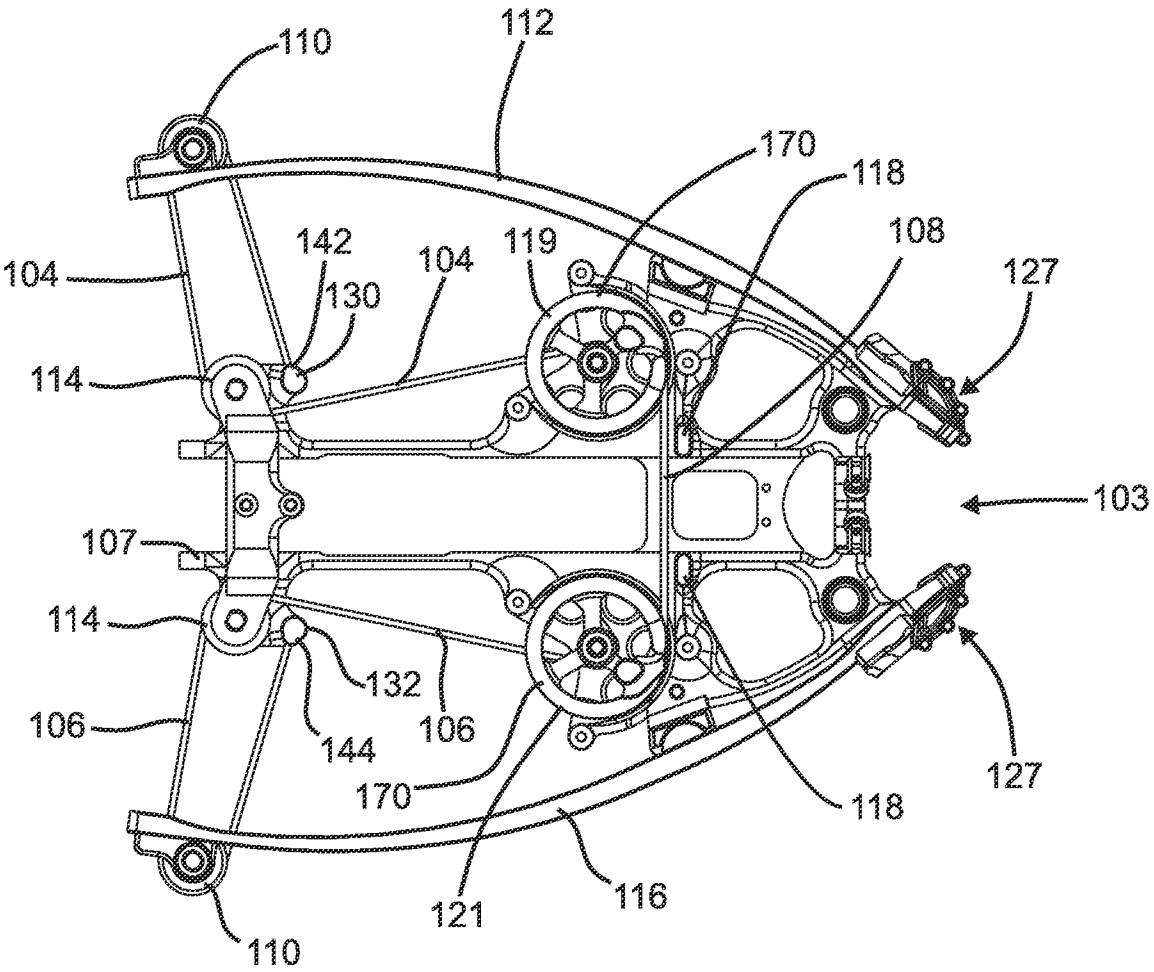
FIG. 8 is a top detail view of examples of a riser, flexible limbs, and pulley system for the example crossbow of FIG. 1, shown in the undrawn position.
Figure 9:
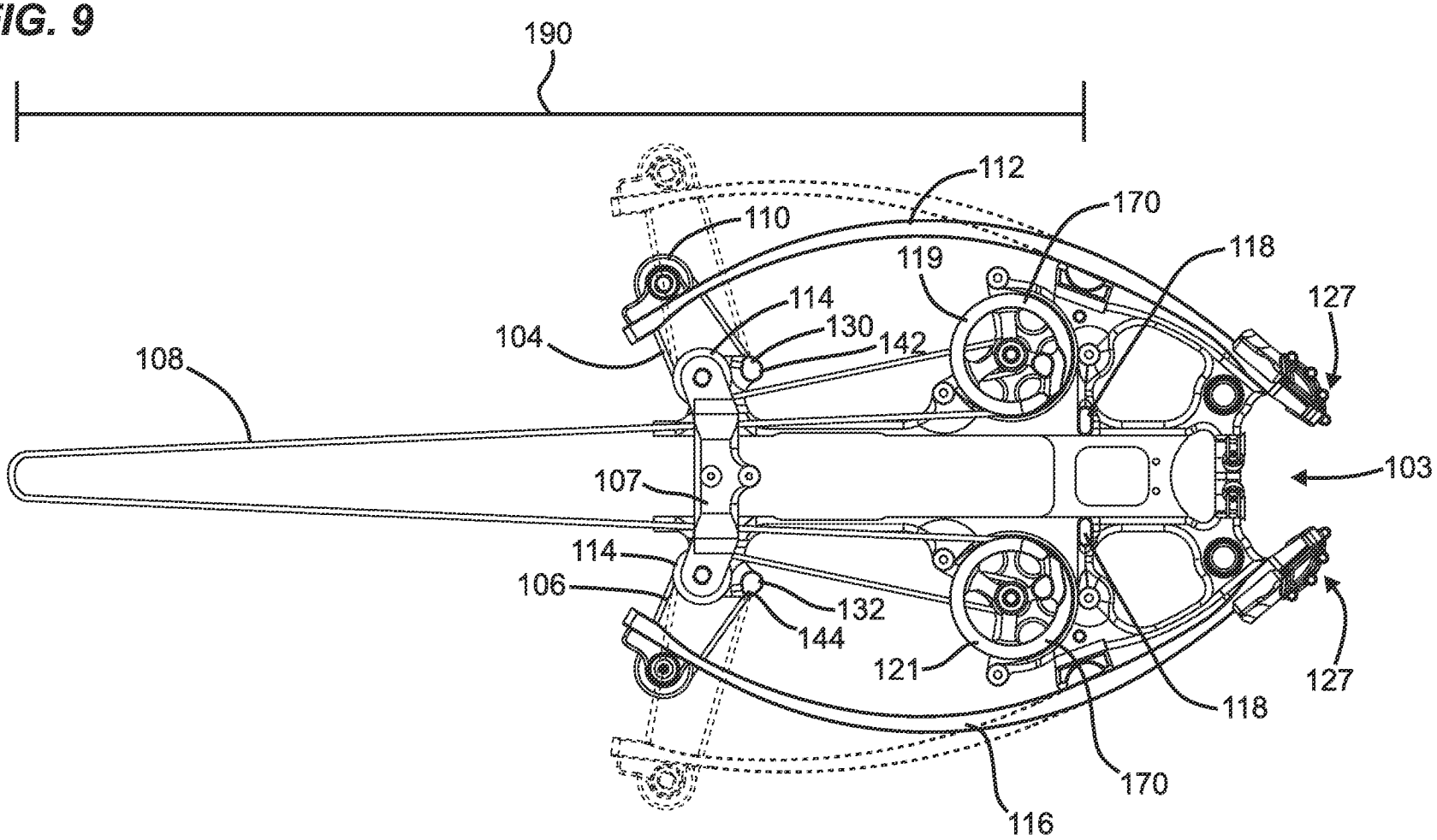
FIG. 9 is another top view of the example riser, flexible limbs, and pulley system for the crossbow of FIG. 1, shown in the drawn position and also showing the undrawn position of the flexible limbs in dashed lines.
Figure 10:
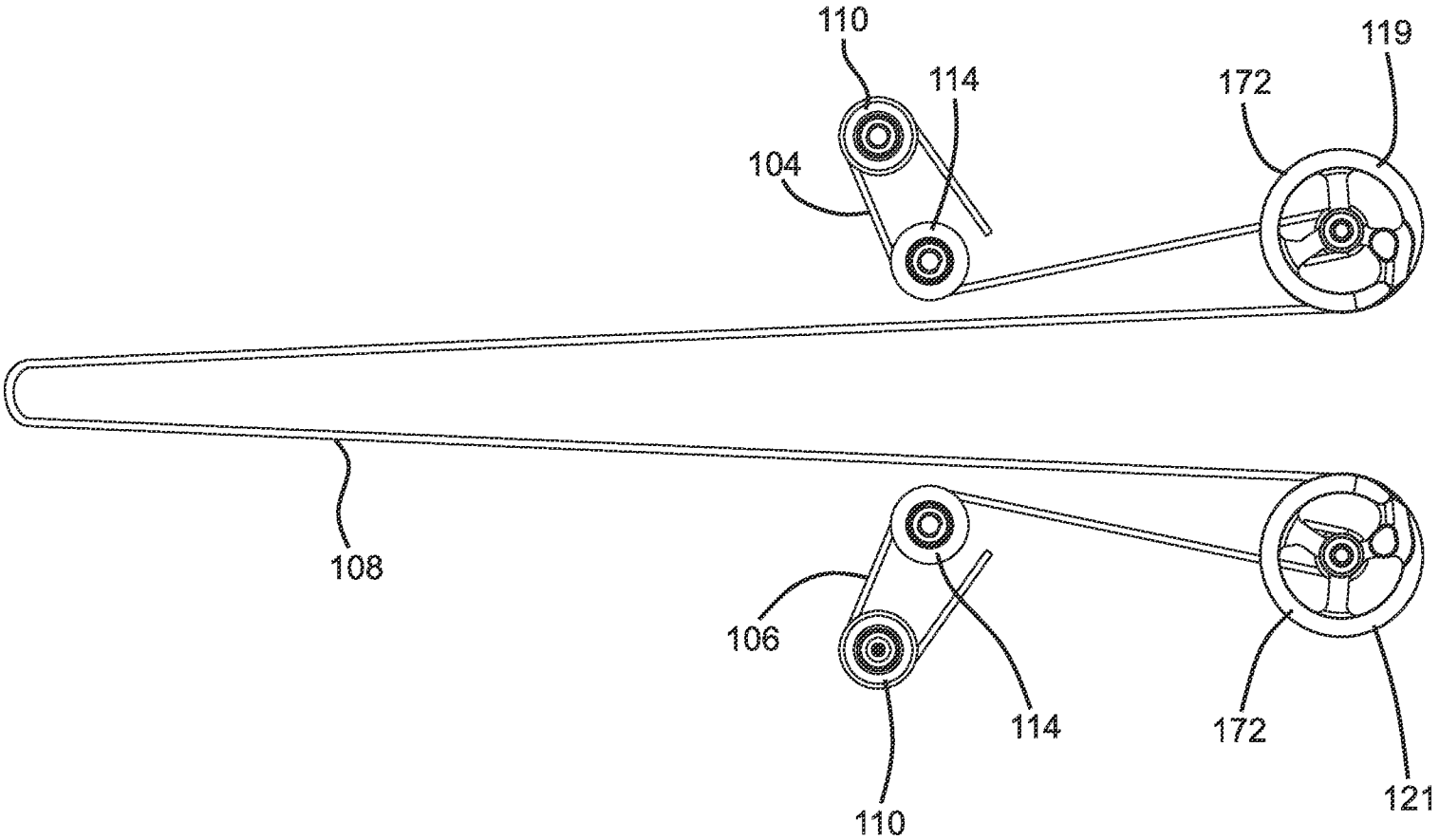
FIG. 10 is a top detail view of an example of the pulley system for the example crossbow of FIG. 1, shown in the drawn position.
Figure 11:
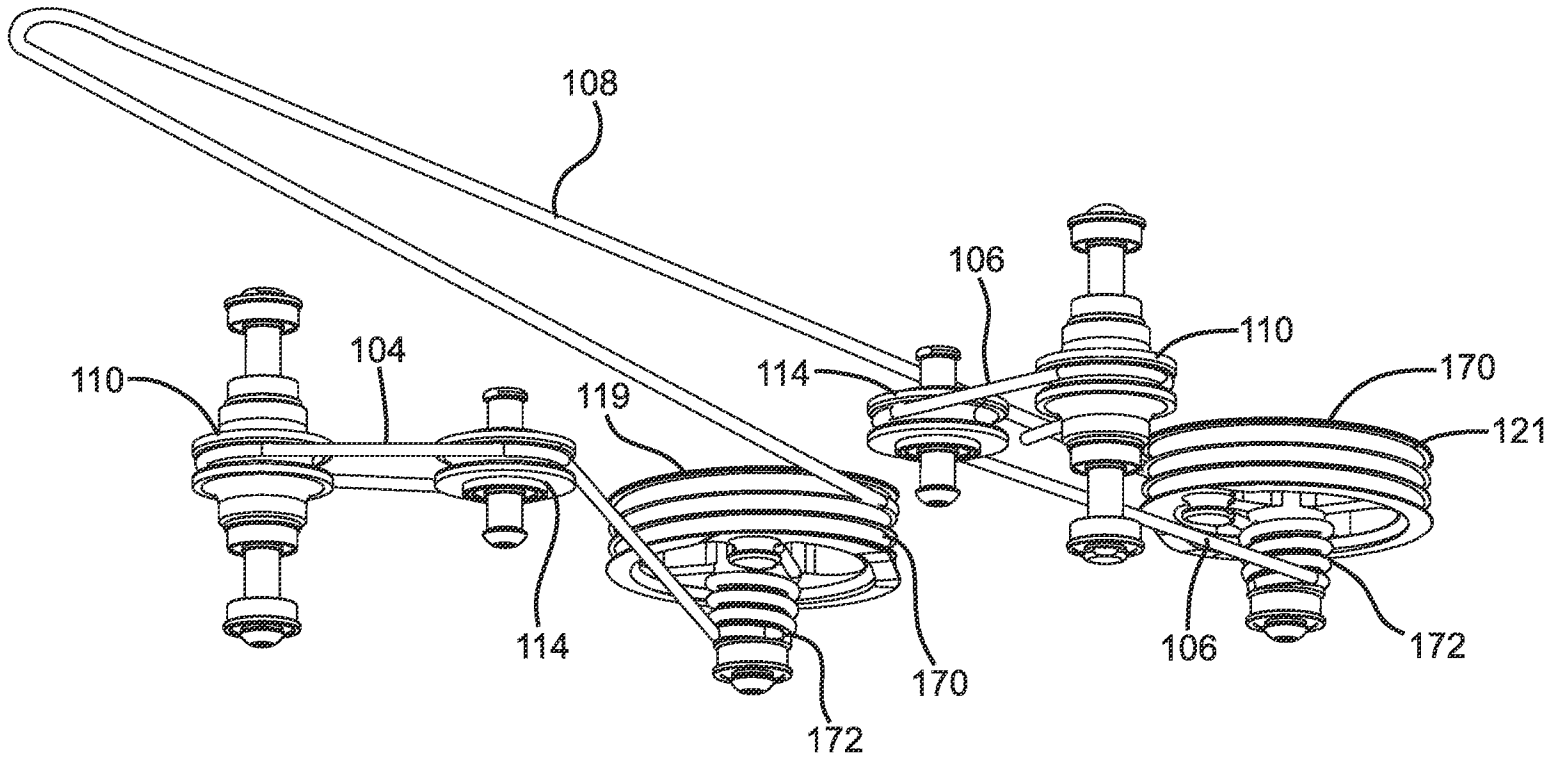
FIG. 11 is a rear bottom perspective view of the example pulley system for the crossbow of FIG. 1, shown in the drawn position.

FIG. 8 shows a top detail view of a portion of the crossbow 100 including the riser 107 but with portions of the frame 102 removed and the power cables 104, 106 and the drawstring 108 in an undrawn position. FIG. 9 shows a top view of the same portion of crossbow 100, with power cables 104, 106 and the drawstring 108 in a drawn position. In the illustrated example, the first and second limbs 112, 116 each include separate members 112*a*/112*b*, 116*a*/116*b*. The separate members 112*a*/112*b*, 116*a*/116*b* of each of the first and second limbs 112, 116 are configured to flex together by way of the power cable 104. It is considered within the scope of the present disclosure that the first and second limbs 112, 116 can include any number of separate members.

FIGS. 8-12 show an example of the arrangement of the cables 104, 106, the drawstring 108, the pulleys 110, 114, and the cams 119, 121 in greater detail.

In this example, the pulleys 110, 114 are each positioned around single shafts 146, 148 (FIG. 12), and the pulleys 110, 114 are rotatable around the shafts 146, 148. As shown, pulleys 110 and 114 are the same diameter, but alternative diameters may be used without departing from the scope of this disclosure. Similarly, in some examples, the shafts 146, 148 have the same or different diameters. In some embodiments the pulleys 110, 114 each include bearings/bushings between the pulleys and shafts 146, 148 to allow the pulleys to freely rotate around the shafts. In some examples, the pulleys 110, 114 are fixed to the shafts 146, 148. In some examples, the shafts 146, 148 are mounted to the limbs 112, 116 or riser 107 via bearings/bushings to allow the shafts 146, 148 to rotate relative to the riser or limbs. Although one pulley 110, 114 is shown at each respective position, it is considered within the scope of the present disclosure that any number of pulleys can be positioned around each shaft 146, 148.

Each pulley 110, 114 includes a groove 152 sized and shaped to receive a power cable 104, 106. In certain embodiments, the groove 152 can be positioned around a circumference of a pulley 110, 114. The pulleys 110, 114 are made from a material to minimize any slippage between the power cables 104, 106 and the pulleys. Any suitable material may be used without departing form the scope of the present disclosure, and may include a surface coating. For example, the pulleys 110, 114 are constructed in a way to allow the power cables 104, 106 to grip and rotate the pulleys 110, 114 as the power cables 104, 106 are moved between the undrawn and drawn positions. For example, groove 152 can be textured, e.g., lined with a high grip material or mechanical feature to grab the power cables 104, 106. In certain embodiments, the pulleys 110, 114 may be constructed of low friction material. In such an example, the pulleys 110, 114 can be fixed relative to the shaft 148. As shown, pulleys 110, 114 are shown as circular, the pulleys 110, 114 can also have other shapes, such as lobe-shaped.

Turning now to FIGS. 19-25, another embodiment of a crossbow 200 is shown. In some embodiments the crossbow 200 is smaller than crossbow 100 described previously and is intended to be used similarly to a pistol, such as without a shoulder stock. As such, the crossbow 200 is shorter and weighs less than crossbow 100 described previously. In the illustrated example, the crossbow 200 includes a frame having a first chassis portion 204, a second chassis portion 206, and a grip 202. The first chassis portion 204, second chassis portion 206, and grip 202 are connected to one another as one or more parts call connected through the frame. The crossbow 200 further has a first end (front end) 203 and a second end (rear end) 205, wherein a projectile is fired from the first end, and the second end is the end closest to the user when the crossbow 200 is fired. In some embodiments, the crossbow 200 further includes a projectile rest 207 that is similar to the projectile rest 120 in the previously described embodiment.

The first and second chassis portions 204, 206 provide portions of the frame to which first and second flexible limbs 208, 210 are attached. In this example, the first and second flexible limbs 208, 210 includes first ends 212, 214, and the first and second flexible limbs 208, 210 are attached to the frame (and first and second chassis portions 204, 206) at the first ends 212, 214. In certain embodiments, the limb pivots 216, 218 may extend from the frame (such as from the chassis portions 204, 206) to provide a fulcrum around which the flexible limbs 208, 210 bend. As shown in this example, the limb pivots 216, 218 are integrally formed into chassis portions 204, 206 but may be separate components in certain alternative embodiments.

The flexible limbs 208, 210 further include second ends 220, 222 that are opposite first ends 212, 214. In certain embodiments, the limb pulleys 224, 226 are positioned at the second ends 220, 222. In the embodiment shown, as a user draws the crossbow 200, the flexible limbs 208, 210 are pulled down toward the chassis portions 204, 206, thereby loading the flexible limbs.

The example shown in FIGS. 19-25 illustrates an example crossbow 200 in which the flexible limbs 208, 210 extend from the frame in an upward and forward orientation, when the crossbow 200 is oriented such that the grip 202 is at the bottom. The limbs can also be arranged in other orientations in other embodiments, such as the orientations illustrated and described herein (e.g., upward and rearward, forward and extending out to the sides, rearward and extending out to the sides, downward and forward, downward and rearward, etc.).

The example crossbow 200 includes first and second power cables 230, 232 that are attached at first ends 234, 236 to the mounting points 238, 240 on the chassis portions 204, 206. In the embodiment shown, the first and second power cables 230, 232 are routed around the limb pulleys 224, 226 and the first and second chassis pulleys 242, 244. The first and second power cables 230, 232 are attached at the second ends 246, 248 to the first and second cams 250, 252 (which can be multiple-wind cams as discussed herein). In certain embodiments, cams 250, 252 include smaller diameter portions 254 and larger diameter portions 256. In the embodiment shown, second ends 246, 248 are attached to the smaller diameter portions 254 of the cams 250, 252. In some embodiments the cams 250, 252 are substantially the same as the cams 119, 121. A drawstring 260 is attached to the larger diameter portions 256 of each of the cams 250, 252.

Many features of the example crossbow 200 are similar to or the same as features of the example crossbow 100, and therefore such features are not repeated herein and reference is made to the previous discussion of crossbow 100.

Figure 22:
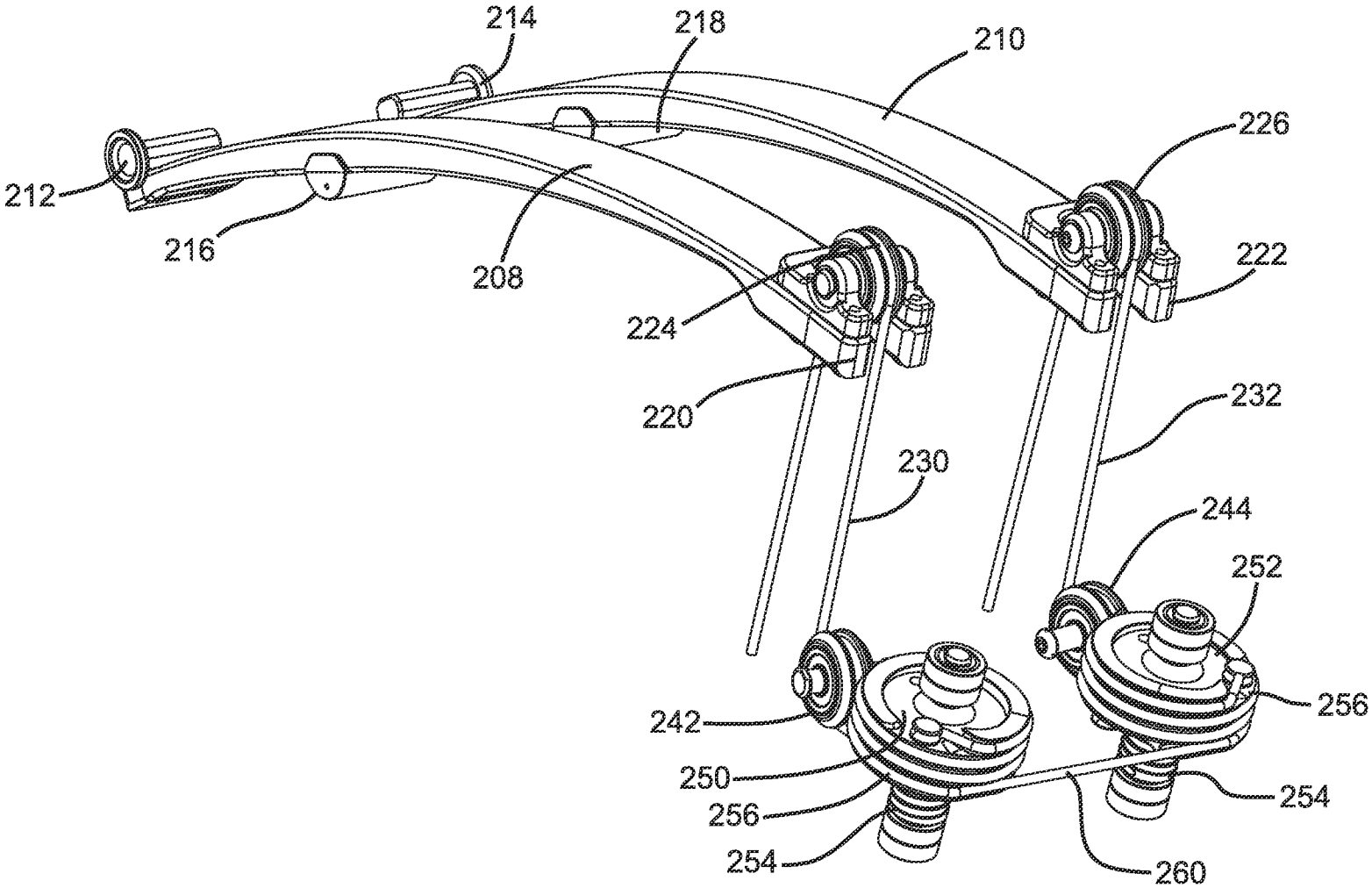
FIG. 22 is a detail perspective view of the example crossbow of FIG. 19, showing the pulley system and flexible limbs in the undrawn position.
Figure 23:
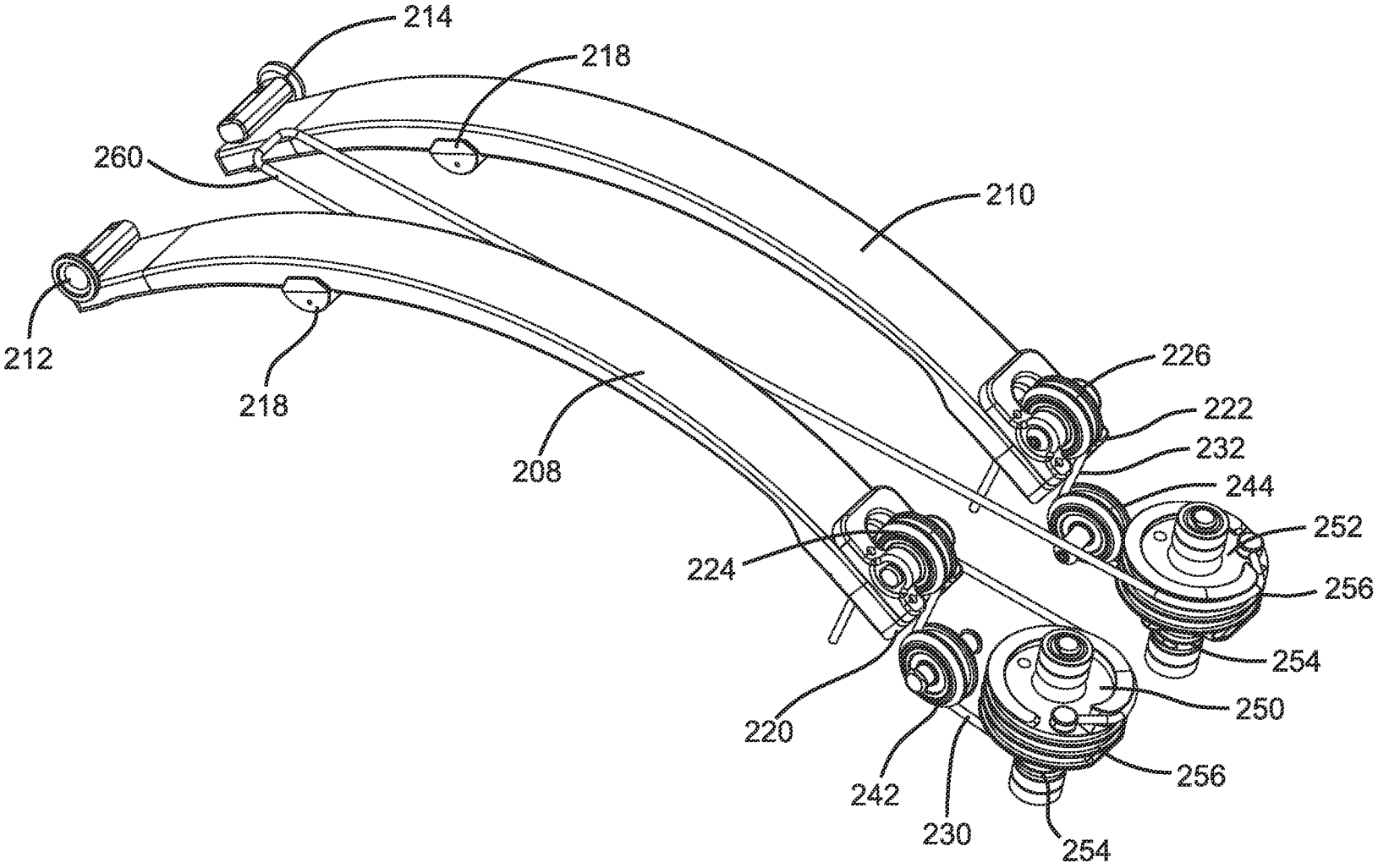
FIG. 23 is another detail perspective view of the example crossbow of FIG. 19, showing the pulley system and flexible limbs in the drawn position.
Figure 24:
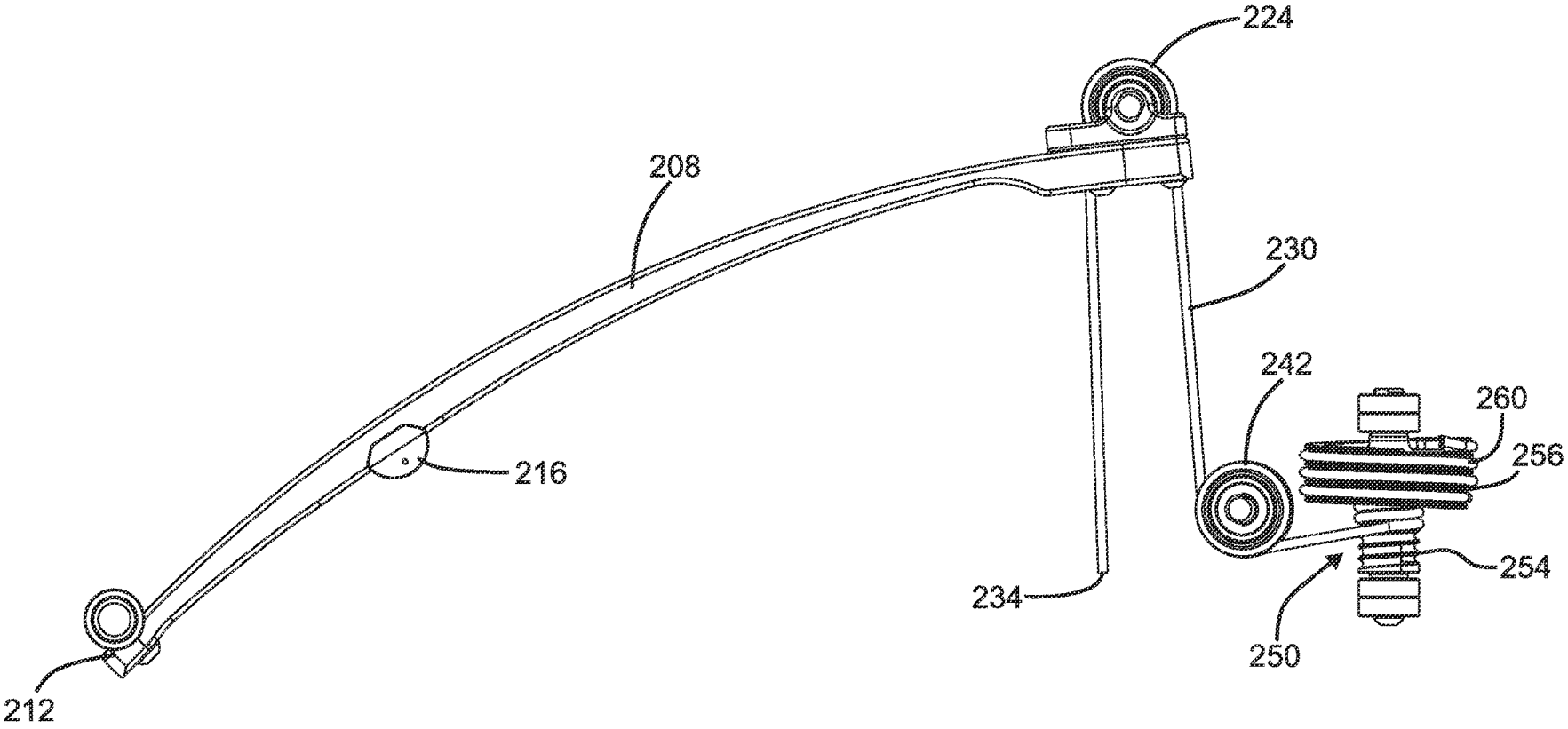
FIG. 24 is a detail side view of the example crossbow of FIG. 19, showing the pulley system and flexible limbs in the undrawn position.
Figure 25:
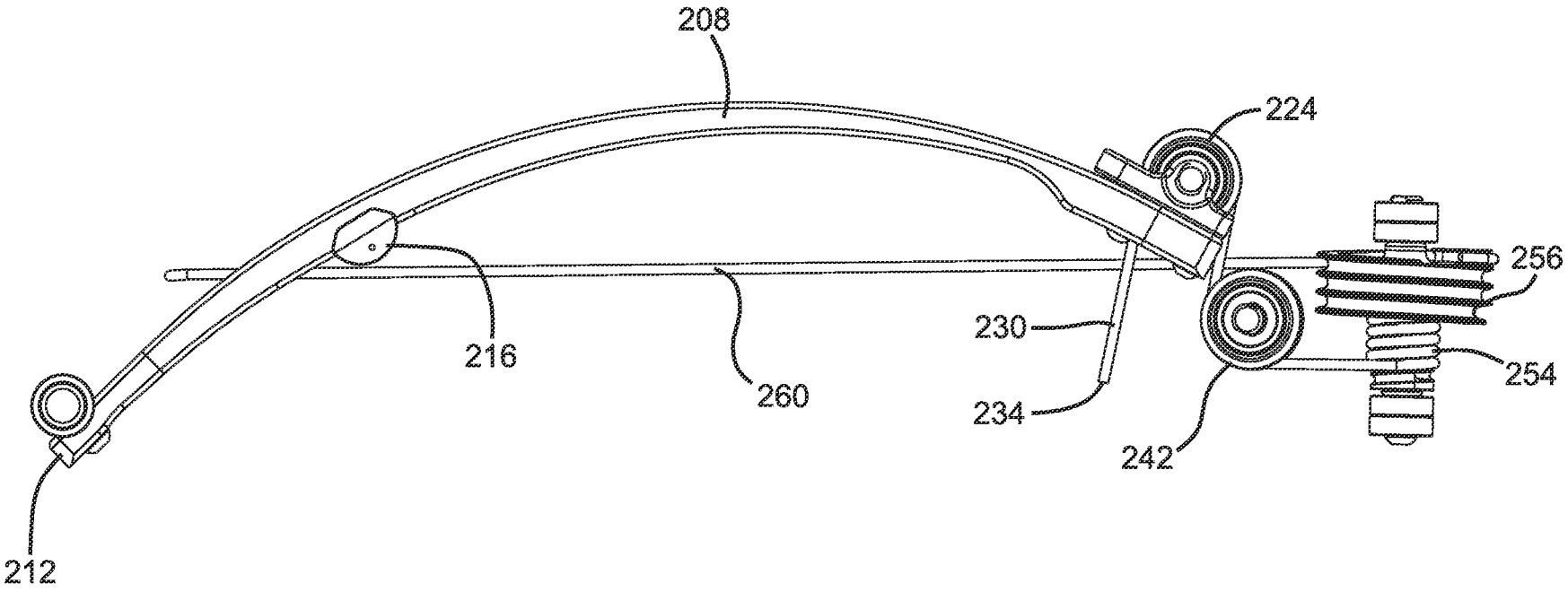
FIG. 25 is a detail side view of the example crossbow of FIG. 19, showing the pulley system and flexible limbs in the undrawn position.

FIGS. 22-25 shows an example arrangement of the flexible limbs 208, 210, power cables 230, 232, drawstring 260, limb pulleys 224, 226, chassis pulleys 242, 244, and cams 250, 252 in an uncocked and cocked position. FIGS. 22 and 24 show the arrangement in the uncocked position and FIGS. 23 and 25 show the arrangement in the cocked position. In the cocked position, the drawstring 260 is pulled toward the first end 212 of the flexible limbs 208, 210 which causes the cams 250, 252 to rotate, thereby unwinding the drawstring from the larger diameter portion 256 of the cams 250,252. At the same time, power cables 230, 232 are wound onto the smaller diameter portions 254 of the cams 250, 252. As the power cables 230, 232 are wound onto the smaller diameter portion 254, flexible limbs 208, 210 are drawn downward, which increases the bending load on the flexible limb. When the crossbow 200 is fired, the drawstring 260 travels toward the front end and carries the projectile with it until the projectile is fired from the front end 203 of the crossbow 200.

Although the embodiments herein described are what are perceived to be the most practical and preferred embodiments, this disclosure is not intended to be limited to the specific embodiments set forth above. Rather, modifications may be made by one of skill in the art of this disclosure without departing from the spirit or intent of the disclosure.

What is claimed is:

1. A crossbow configured to fire a projectile along a projectile axis from a front end, the crossbow comprising:

a frame including a riser, the frame having a first frame side and a second frame side;

a first and second cams, the first and second cams attached to the frame, each cam having a larger diameter portion and a smaller diameter portion;

a first flexible limb and a second flexible limb, each of the first and second flexible limbs having a first end and a second end, wherein the first and second flexible limbs are in an unloaded position when the crossbow is undrawn and in a loaded position when the crossbow is drawn;

a first power cable at the first frame side, the first power cable having a first end and a second end, the first end attached to a first stationary mounting position on the riser and the second end attached to the smaller diameter portion of the first cam;

a second power cable at the second frame side, the second power cable having a first end and a second end, the first end attached to a second stationary mounting position on the riser and the second end attached to the smaller diameter portion of the second cam;

a drawstring attached to the larger diameter portion of the first cam and to the larger diameter portion of the second cam; and wherein the drawstring wraps at least one full wind around the larger diameter portions of the cams when the crossbow is undrawn and wherein the first and second power cables wrap at least one full wind around the smaller diameter portions of the first and second cams respectively when the crossbow is in the loaded position.

2. The crossbow of claim 1, wherein the first and second cams are multiple-wind cams.

3. The crossbow of claim 1, wherein the first and second cams have a vertical axis of rotation.

4. The crossbow of claim 1, wherein the first ends of the first and second limbs are attached to the riser.

5. The crossbow of claim 1, further comprising:

a first power group including the first power cable, wherein the first power cable is routed around a first riser pulley attached to the riser and a first power cable pulley attached to the second end of the first flexible limb; and a second power group including the second power cable, wherein the second power cable is routed around a second riser pulley attached to the riser and a second power cable pulley attached to the second end of the second flexible limb.

6. The crossbow of claim 1, wherein the frame includes a stock positioned at a rear end of the frame, the stock being configured to be positioned against a user's shoulder.

7. The crossbow of claim 1, further comprising a projectile rest positioned at the front end of the riser, the projectile rest being configured to at least partially support the projectile.

8. The crossbow of claim 1, further comprising a latch that selectively receives and retains the drawstring at a rear end of the frame.

9. The crossbow of claim 1, wherein the smaller diameter portion and larger diameter portion of each cam are coaxial.

10. The crossbow of claim 1, wherein the smaller diameter portion and larger diameter portion of each cam include helical grooves that receive one of the first power cable, second power cable, and drawstring.

11. The crossbow of claim 1, further including a top bridge attached to the riser and positioned between the first and second cams.

12. The crossbow of claim 1, wherein the drawstring wraps a plurality of full winds around the larger diameter portions of the cams when the crossbow is undrawn and wherein the first and second power cables wrap a plurality of full winds around the smaller diameter portions of the cams when the crossbow is in the loaded position.

13. The crossbow of claim 1, the drawstring having a first end and a second end, the first end of the drawstring being attached to the larger diameter portion of the first cam, and the second end of the drawstring being attached to the larger diameter portion of the second cam.

14. The crossbow of claim 1, wherein the first and second cams are attached to the riser.

15. A crossbow comprising:

a frame including a riser and an opening along a projectile axis, wherein the crossbow is configured to move a projectile along the projectile axis during firing and arming of the crossbow, wherein the projectile is fired from a front end of the frame;

a first and a second cam attached to the frame, each of the first and second cams having a larger diameter portion and a smaller diameter portion;

a first flexible limb and a second flexible limb, each of the first and the second limbs having a first end attached to the frame and a second end, wherein the first and second flexible limbs are in an unloaded position when the crossbow is undrawn and in a loaded position when the crossbow is drawn;

a first power group at a first frame side, the first power group including a first power cable, a first power cable pulley, a first frame pulley, and the first cam, wherein a first end of the first power cable is attached to a first stationary mounting position on the riser, the first power cable is routed around the first power cable pulley attached to the second end of the first flexible limb, the first power cable is further routed around the first frame pulley attached to the frame, and a second end of the first power cable is attached to the smaller diameter portion of the first cam;

a second power group at a second frame side, the second power group including a second power cable, a second power cable pulley, a second frame pulley, and the second cam, wherein a first end of the second power cable is attached to a second stationary mounting position on the riser, the second power cable is routed around the second power cable pulley attached to the second end of the second flexible limb, the second power cable is further routed around the second frame pulley attached to the frame, and the second end of the second power cable is attached to the smaller diameter portion of the second cam;

a drawstring having a first and a second end, wherein the first end of the drawstring is attached to the larger diameter portion of the first cam and the second end of the drawstring is attached to the larger diameter portion of the second cam; and wherein the drawstring wraps around the larger diameter portions of the cams when the crossbow is undrawn and wherein the first and second power cables wrap around the smaller diameter portions of the cams when the crossbow is in the loaded position.

16. The crossbow of claim 15, wherein the first and second cams have vertical axes of rotation.

17. The crossbow of claim 15, wherein the first and second cams are independent.

18. The crossbow of claim 15, wherein the first and second cams have grooves formed in the larger diameter portion and in the smaller diameter portion, wherein the grooves extend at least two full rotations around the larger diameter portion and the smaller diameter portion.

19. The crossbow of claim 15, further comprising a projectile rest positioned at the front end of the frame, the projectile rest being configured to at least partially support the projectile.

20. A crossbow comprising:

a frame having a projectile axis, wherein a projectile moves along the projectile axis during firing of the crossbow;

a multiple-wind cam attached to the frame, having a larger diameter portion and a smaller diameter portion, wherein the larger diameter portion has a larger diameter than the smaller diameter portion;

a flexible limb having a first end attached to the frame and a second end, wherein the flexible limb is in an unloaded position when the crossbow is undrawn and in a loaded position when the crossbow is drawn;

a power group including a power cable having a first and second end, the first end attached to a stationary mounting position on the frame, the power cable routed around a pulley, and the second end attached to the smaller diameter portion of the multiple-wind cam; and a drawstring having a first and second end, wherein the first end is attached to the larger diameter portion of the multiple-wind cam, wherein the drawstring wraps around the larger diameter portion of the multiple-wind cam when the crossbow is undrawn and wherein the power cable wraps around the smaller diameter portion of the multiple-wind cam when the crossbow is in the loaded position.

* * * * *